US006000466A

United States Patent [19]

Aoyagi et al.

[11] Patent Number: 6,000,466

[45] Date of Patent: Dec. 14, 1999

[54] HEAT EXCHANGER TUBE FOR AN AIR-CONDITIONING APPARATUS

[75] Inventors: Osamu Aoyagi; Shoichi Yokoyama, both of Ootsu; Hitoshi Motegi, Kusatsu, all of Japan

[73] Assignee: Matsushita Electric Industrial Co., Ltd., Osaka, Japan

[21] Appl. No.: 08/649,952

[22] Filed: May 16, 1996

[30] Foreign Application Priority Data

May 17, 1995 [JP] Japan ..... 7-118200

[51] Int. Cl.[6] ..... F28F 1/40

[52] U.S. Cl. ..... 165/133; 165/183

[58] Field of Search ..... 165/133, 181, 165/183, 184, 179

[56] References Cited

U.S. PATENT DOCUMENTS

| | | | |
|---|---|---|---|
| 4,733,698 | 3/1988 | Sato | 165/179 X |
| 5,052,476 | 10/1991 | Sukumoda et al. | 165/133 |
| 5,186,252 | 2/1993 | Nishizawa et al. | 165/181 |
| 5,333,682 | 8/1994 | Liu et al. | 165/133 |

FOREIGN PATENT DOCUMENTS

| | | | |
|---|---|---|---|
| 196598 | 10/1985 | Japan | 165/133 |
| 314898 | 12/1989 | Japan | 165/184 |
| 186196 | 8/1991 | Japan | 165/184 |
| 189013 | 8/1991 | Japan . | |
| 126998 | 4/1992 | Japan | 165/133 |
| 126999 | 4/1992 | Japan | 165/133 |
| 21117 | 4/1992 | Japan . | |
| 147786 | 5/1994 | Japan | 165/181 |

*Primary Examiner*—Leonard R. Leo
*Attorney, Agent, or Firm*—Pollock, Vande, Sande & Priddy

[57] ABSTRACT

A groove configuration, formed on an inside wall of a heat exchanger tube, has a cross-sectional area varying in the longitudinal direction of the heat exchanger tube. An increased rate of the cross-sectional area is differentiated from a decreased rate of the cross-sectional area by changing the height or top width of a protruding portion, or the depth or bottom width of a recessed portion.

25 Claims, 17 Drawing Sheets

HEAT EXCHANGER TUBE FOR AN AIR-CONDITIONING APPARATUS

BACKGROUND OF THE INVENTION

1. Field of the Invention

The present invention generally relates to a heat-transfer tube or pipe equipped in a heat exchanger for use in an air-conditioning apparatus or the like, and more particularly to a heat exchanger tube preferably used for an air-conditioning apparatus using non-azeotropic coolant.

2. Prior Art

One conventional heat exchanger tube will be explained with reference to FIGS. 17 and 18. FIG. 17 is a perspective view showing a heat exchanger tube 1. In FIG. 17, heat exchanger tube 1 has an end being cut obliquely with respect to a center line 3 of heat exchanger tube 1. A plurality of grooves 2 are formed on an inside wall of heat exchanger tube 1.

FIG. 18 is a perspective view enlargedly showing a conventional groove configuration at a portion corresponding to "A" of FIG. 17. Ridge portion of the groove configuration comprises a top surface 4 and side surfaces 5. Between parallel two ridge portions, there is provided a flat bottom (recessed portion) 6.

Top surface 4 extends flatly in the longitudinal direction thereof. Opposed two side surfaces 5 are inclined with respect to bottom 6 at the same angle β.

FIG. 19 is a perspective view enlargedly showing another conventional groove configuration at a portion corresponding to "A" of FIG. 17, for example shown in Unexamined Japanese Patent Application No. HEI 3-189013, disclosed in 1991. Each protrusion, formed on an inside wall of heat exchanger tube, comprises a slant surface 7. A bottom comprises a slant surface 8 and a stepped portion 9.

However, if the former conventional groove configuration is adopted for a heat exchanger tube of the air-conditioning apparatus using non-azeotropic coolant, it will encounter the following problems. Non-azeotropic coolant has a difference between its boiling point and its dew point under the same pressure. When the difference between its boiling point and its dew point is approximately 5° C., an inlet temperature at a vaporizer is decreased to −2.5° C. under settings of an average vaporization temperature at 0° C. The surface of fins near the inlet of the vaporizer will be bothered with icing of condensed water, deteriorating the ability of the heat exchanger.

To prevent such icing phenomenon, pressure loss in the heat exchanger tube is normally increased by changing the groove configuration in the heat exchanger tube, reducing the inner diameter of the heat exchanger tube, or reducing the number of fluid passages in the heat exchanger. Increase of pressure loss in the heat exchanger tube leads to an increase of inlet pressure and increase of inlet temperature.

However, to increase the pressure loss in the heat exchanger tube, using the former conventional groove configuration will undesirably increase the pressure loss in the condenser. Increase of pressure loss in the condenser leads to decrease of condensation temperature, deteriorating the condensation ability.

According to the latter conventional groove configuration, fluid in a vaporization phase flows in the direction of "B" while the fluid in a condensation phase flows in the direction of "C". Slant surface 7 acts to reduce the pressure loss in the condensation phase, however stepped portion 9 acts to increase the pressure loss in the condensation phase. In short, slant surface 7 and stepped portion 9 act oppositely in such a manner that they mutually cancel their effects. According to the latter conventional groove configuration, protrusions and recesses are formed by changing the pressure of rolling processing so as to form a protrusion by an amount excluded from a recess. In other words, a cross-sectional area normal to the center line of the heat exchanger tube is not changed regardless of formation of protrusions and recesses.

SUMMARY OF THE INVENTION

Accordingly, in view of above-described problems encountered in the prior art, a principal object of the present invention is to provide a novel and excellent chip bonding method capable of eliminating or suppressing the generation of voids.

In order to accomplish this and other related objects, the present invention provides a heat exchanger tube comprising: a groove configuration formed on an inside wall of the heat exchanger tube so as to have a cross-sectional area normal to a center line of the heat exchanger tube; the groove configuration having a first region and a second region where the cross-sectional area of the groove configuration varies, wherein the cross-sectional area of the groove configuration increases in the first region while the cross-sectional area decreases in the second region, and an increased rate of the cross-sectional area in the first region is differentiated from a decreased rate of the cross-sectional area in the second region.

According to features of preferred embodiments of the present invention, the cross-sectional area of the groove configuration varies in accordance with a change of the configuration of plural grooves formed on the inside wall of the heat exchanger tube. Or, the cross-sectional area of the groove configuration varies in accordance with a change of the height of a protruding portion constituting part of the groove configuration formed on the inside wall of the heat exchanger tube. Or, the cross-sectional area of the groove configuration varies in accordance with a change of the depth of a recessed portion constituting part of the groove configuration formed on the inside wall of the heat exchanger tube.

Furthermore, the cross-sectional area of the groove configuration varies in accordance with a change of the top width of the protruding portion, or varies in accordance with a change of the bottom width of the recessed portion, or varies in accordance with a change of the height of the protruding portion and a change of the depth of the recessed portion.

Still further, the cross-sectional area of the groove configuration varies in accordance with a change of the height of the protruding portion and a change of the top width of the protruding portion, or varies in accordance with a change of the height of the protruding portion and a change of the bottom width of the recessed portion.

Yet further, the cross-sectional area of the groove configuration varies in accordance with a change of the depth of the recessed portion and a change of the top width of the protruding portion, or varies in accordance with a change of the depth of the recessed portion and a change of the bottom width of the recessed portion.

Moreover, the cross-sectional area of the groove configuration varies in accordance with a change of the top width of the protruding portion and a change of the bottom width of the recessed portion, or varies in accordance with a change of the height and the top width of the protruding portion and a change of the depth of the recessed portion.

Furthermore, the cross-sectional area of the groove configuration varies in accordance with a change of the height of the protruding portion and a change of the depth and the bottom width of the recessed portion, or varies in accordance with a change of the top width of the protruding portion and a change of the depth and the bottom width of the recessed portion.

Still further, the cross-sectional area of the groove configuration varies in accordance with a change of the height and the top width of the protruding portion and a change of the depth and the bottom width of the recessed portion.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1A:
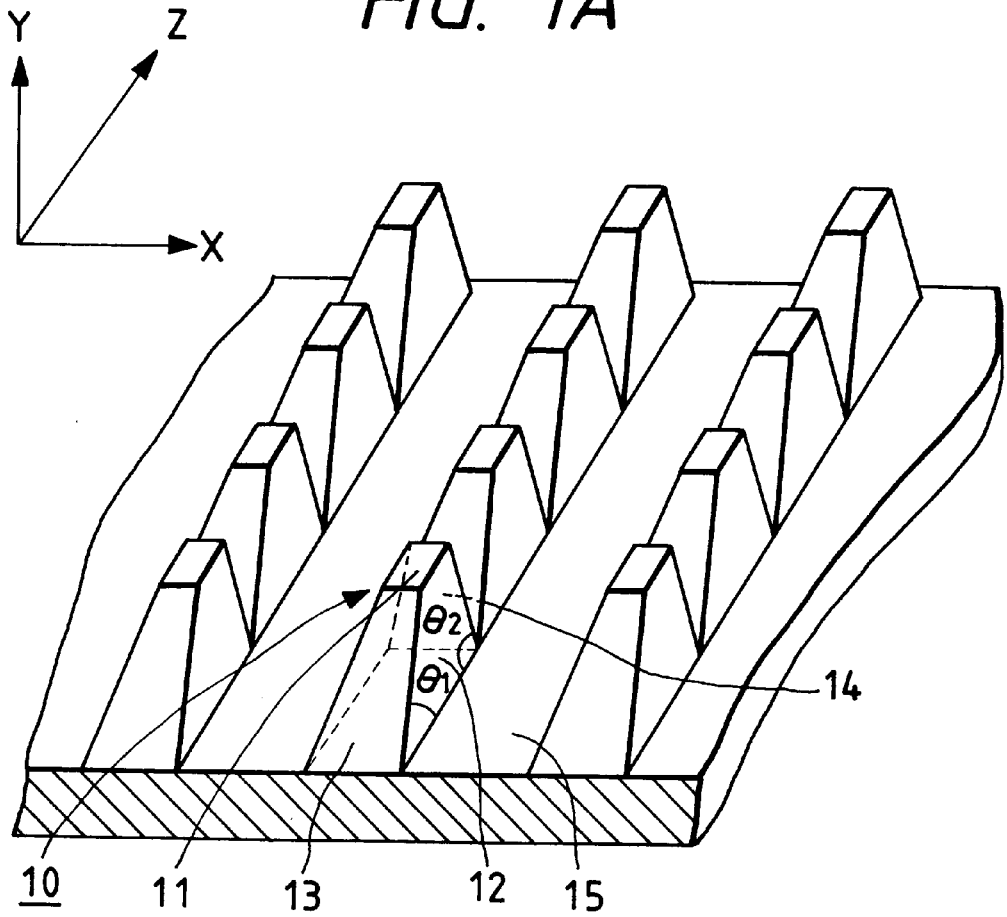
FIG. 1A is a perspective view showing a groove configuration formed on an inside wall of a heat exchanger tube in accordance with a first embodiment of the present invention.

Preferred embodiments of the present invention will be explained in greater detail hereinafter, with reference to the accompanying drawings. Identical parts are denoted by an identical reference numeral throughout views. In the drawings, Z-axis represents the direction of grooves formed on the inside all of each heat exchanger tube, X-axis represents the direction normal to the Z-axis and parallel to the inside wall of the heat exchanger, and Y-axis represents the direction normal to the Z-axis and also normal to the inside wall of the heat exchanger tube. For a simplified explanation, Z-axis direction coincides with the longitudinal direction (i.e. center line) of the heat exchanger tube in many of the following embodiments of the present invention. However, it is needless to say that Z-axis is inclined with respect to the longitudinal direction of the heat exchanger tube when the heat exchanger tube has spiral grooves formed on the inside wall thereof.

First Embodiment

Figure 1B:
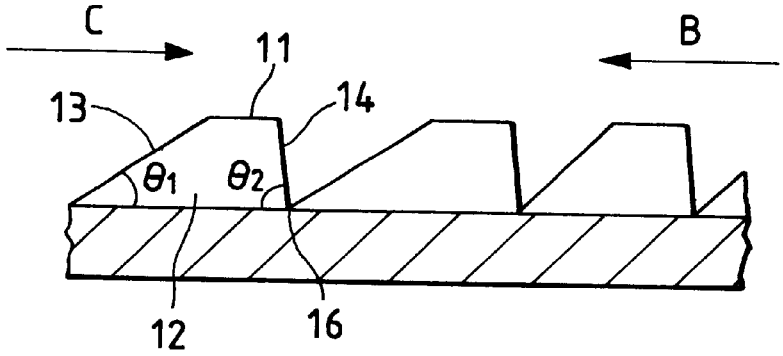
FIG. 1B is a cross-sectional side view showing the groove configuration of FIG. 1A.

A first embodiment of the present invention will be explained with reference to FIGS. 1A and 1B. FIG. 1A is a perspective view showing a groove configuration formed on an inside wall of a heat exchanger tube in accordance with the first embodiment of the present invention. FIG. 1B is a cross-sectional side view showing the groove configuration of FIG. 1A.

A plurality of protrusions 10, provided on the inside wall of the heat exchanger tube, are sequentially aligned in plural lines extending in the Z-axis direction of the heat exchanger tube (i.e. direction of fluid flow).

Each protrusion 10 is formed into the same configuration like a truncated pyramid extending in the Z-axis direction of the heat exchanger tube. More specifically, each protrusion 10 comprises a top surface 11, two side surfaces 12, a gradual slant surface 13, and a steep slant surface 14.

Top surface 11 is parallel to the X-Z plane and extends in the Z-axis direction of the heat exchanger tube. Side surfaces 12 are substantially parallel to the Y-Z plane and extend in the Z-axis of the heat exchanger tube. These surfaces 11 and 12 do not act as substantial resistance to the fluid flow.

Gradual slant surface 13 and steep slant surface 14 are opposed to each other in the direction of fluid flow (i.e. Z-axis direction of the heat exchanger tube).

Gradual slant surface 13 has a base angle θ1, while steep slant surface 14 has a base angle θ2. Base angle θ2 is larger than base angle θ1. Steep slant surface 14 of one protrusion 10 intersects with gradual slant surface 13 of the succeeding protrusion 10 at an intersect point 16 of the same level as a flat bottom (i.e. recess) 15.

Gradual slant surface 13 faces against the fluid flow "C" in a condensation phase. On the other hand, steep slant surface 14 faces against the fluid flow "B" in a vaporization phase.

When the fluid in the heat exchanger tube is vaporized, fluid flow "B" collides with steep slant surface 14 having base angle θ2. Resistance to the fluid flow "B" is fairly large due to steepness of slant surface 14. Hence, in the vaporization phase of the fluid in the heat exchanger tube, it becomes possible to effectively cause disturbance in the fluid flow "B", increasing pressure loss (i.e. resistance to the fluid flow "B").

On the other hand, when the fluid in the heat exchanger tube is condensed, fluid flow "C" collides with gradual slant surface 13 having base angle θ1smaller than θ2. Gradualness of slant surface 13 brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the pressure loss (i.e. resistance to the fluid flow "C").

Formation of side surfaces 12 enlarges the wetted area or length, realizing a high efficiency in heat exchange.

Each bottom (recessed) surface 15, provided between adjacent two rows of sequentially aligned protrusions 10, is parallel to the X-Z plane and extends flatly in the Z direction (i.e. the direction of fluid flow).

Regarding the size or area of top surface 11, it can be reduced to zero if necessary; in such a case, gradual slant surface 13 and steep slant surface 14 directly intersect with each other at a higher point.

Regarding the space between two consecutively aligned protrusions 10 and 10, it can be extended adequately so that one protrusion 10 is separated from the succeeding protrusion 10 with a desired clearance.

As apparent from the foregoing description, the first embodiment of the present invention provides a heat exchanger tube having an inside wall groove configuration whose cross-sectional area normal to the center line thereof varies in such a manner that the increased rate of the cross-sectional area is differentiated from the decreased rate of the cross-sectional area (i.e. the increased rate is always larger than the decreased rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

More specifically, according to the first embodiment, the cross-sectional area of the groove configuration varies in accordance with a change of the height of a protruding portion constituting part of the groove configuration formed on the inside wall of the heat exchanger tube.

Second Embodiment

Figure 2A:
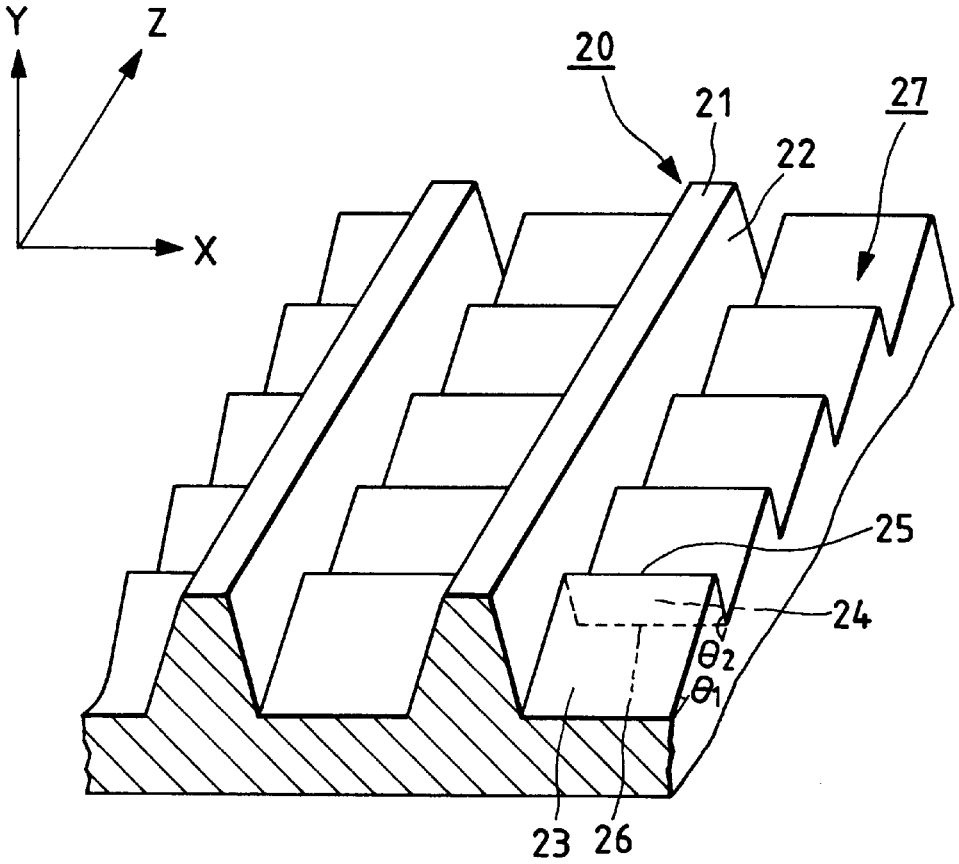
FIG. 2A is a perspective view showing a groove configuration formed on an inside wall of a heat exchanger tube in accordance with a second embodiment of the present invention.
Figure 2B:
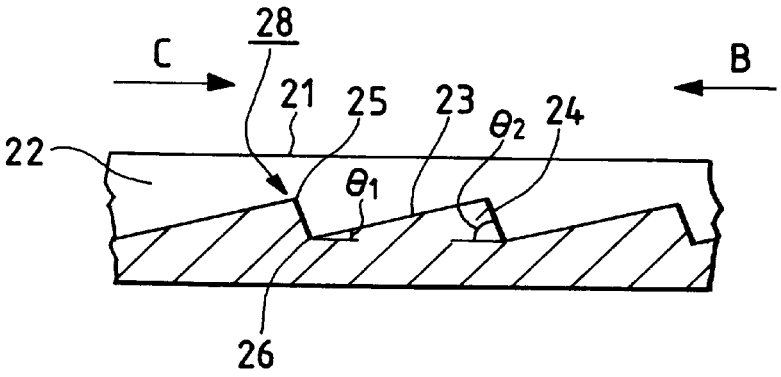
FIG. 2B is a cross-sectional side view showing the groove configuration of FIG. 2A.

A second embodiment of the present invention will be explained with reference to FIGS. 2A and 2B. FIG. 2A is a perspective view showing a groove configuration formed on an inside wall of a heat exchanger tube in accordance with the second embodiment of the present invention. FIG. 2B is a cross-sectional side view showing the groove configuration of FIG. 2A.

A plurality of parallel ridges 20, each extending in the Z-axis direction (i.e. the direction of fluid flow), are provided on the inside wall of the heat exchanger tube.

Each ridge 20 has a top surface 21 parallel to the X-Z plane and extending in the Z-axis direction of the heat exchanger tube, and side surfaces 22 substantially parallel to the Y-Z plane and extending in the Z-axis direction of the heat exchanger tube. These surfaces 21 and 22 do not act as substantial resistance to the fluid flow.

Between adjacent two parallel ridges 20 and 20, there is formed an undulated bottom 27 extending in the Z-axis direction of the heat exchanger tube (i.e. the direction of fluid flow).

Undulated bottom 27 comprises a plurality of waves 28. Each wave 28 comprises a gradual slant surface 23 having a base angle θ1and a steep slant surface 24 having a base angle θ2. Base angle θ2 is larger than base angle θ1. Gradual slant surface 23 intersects with steep slant surface 24 along a crest line 25 extending in the X direction of the heat exchanger tube. Steep slant surface 23 of one wave 28 intersects with gradual slant surface 24 of the succeeding wave 28 along a base line 26 extending in the direction X of the heat exchanger tube.

Gradual slant surface 23, inclined at base angle θ1 with respect to the X-Z plane, faces against the fluid flow "C" in a condensation phase. Steep slant surface 24, inclined at base angle θ2 with respect to the X-Z plane, faces against the fluid flow "B" in a vaporization phase.

When the fluid in the heat exchanger tube is vaporized, fluid flow "B" collides with steep slant surface 24 having base angle θ2. Resistance to the fluid flow "B" is fairly large due to steepness of slant surface 24. Hence, in the vaporization phase of the fluid in the heat exchanger tube, it becomes possible to effectively cause disturbance in the fluid flow "B", increasing the pressure loss (i.e. resistance to the fluid flow "B").

On the other hand, when fluid in the heat exchanger tube is condensed, fluid flow "C" collides with gradual slant surface 23 having base angle θ1 smaller than θ2. Gradualness of slant surface 23 brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the resistance to the fluid flow "C".

Formation of side surfaces 22 of ridges 20 enlarges the wetted area or length, realizing a high efficiency in heat exchange.

Regarding the crest of each wave 28, it can be flatted if necessary. Regarding the space between two consecutively aligned waves 28 and 28, it can be extended adequately.

Figure 15A:
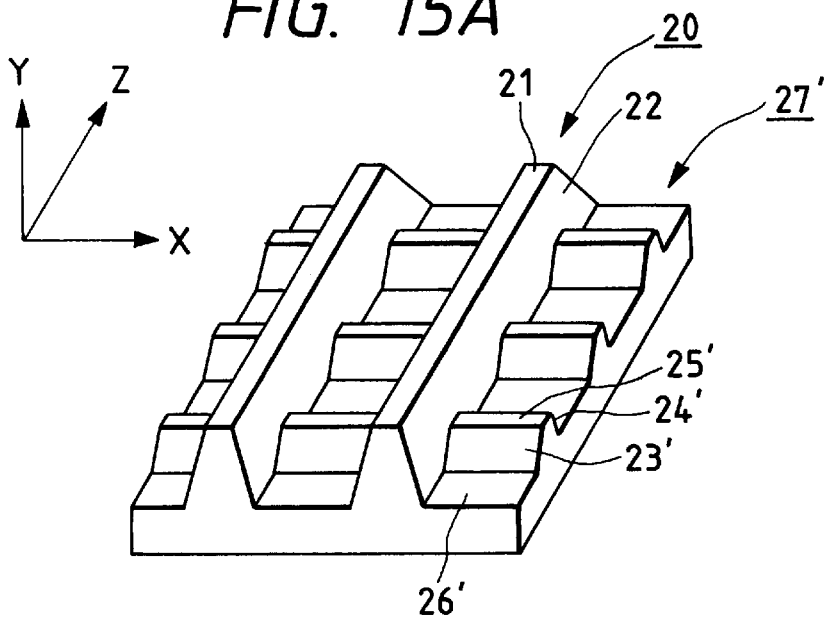
FIG. 15A is a perspective view showing a groove configuration formed on an inside wall of a heat exchanger tube in accordance with a modification of the second embodiment of the present invention.
Figure 15B:
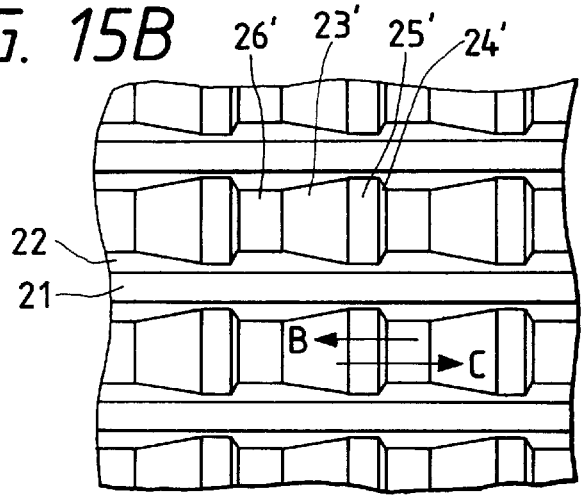
FIG. 15B is a plan view showing the groove configuration of FIG. 15A.
Figure 15C:
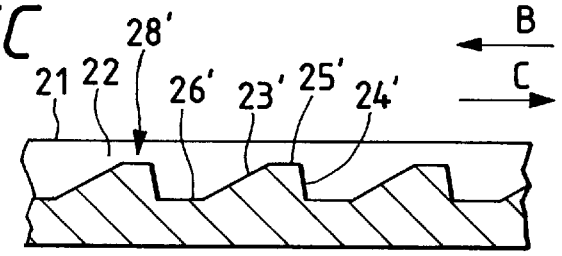
FIG. 15C is a cross-sectional side view showing the groove configuration of FIG. 15A.

For example, the second embodiment can be modified as shown in FIGS. 15A to 15C, wherein an undulated bottom 27' comprises a gradual slant surface 23' connected to a steep slant surface 24' via a flat surface 25' extending in the X direction. One wave 28' is separated via a flat surface 26' from the succeeding wave 28'.

As apparent from the foregoing description, the second embodiment of the present invention provides a heat exchanger tube having an inside wall groove configuration whose cross-sectional area normal to the center line thereof varies in such a manner that the increased rate of the cross-sectional area is differentiated from the decreased rate of the cross-sectional area (i.e. the increased rate is always larger than the decreased rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

More specifically, according to the second embodiment, the cross-sectional area of the groove configuration varies in accordance with a change of the depth of a recessed portion constituting part of the groove configuration formed on the inside wall of the heat exchanger tube.

Third Embodiment

Figure 3A:
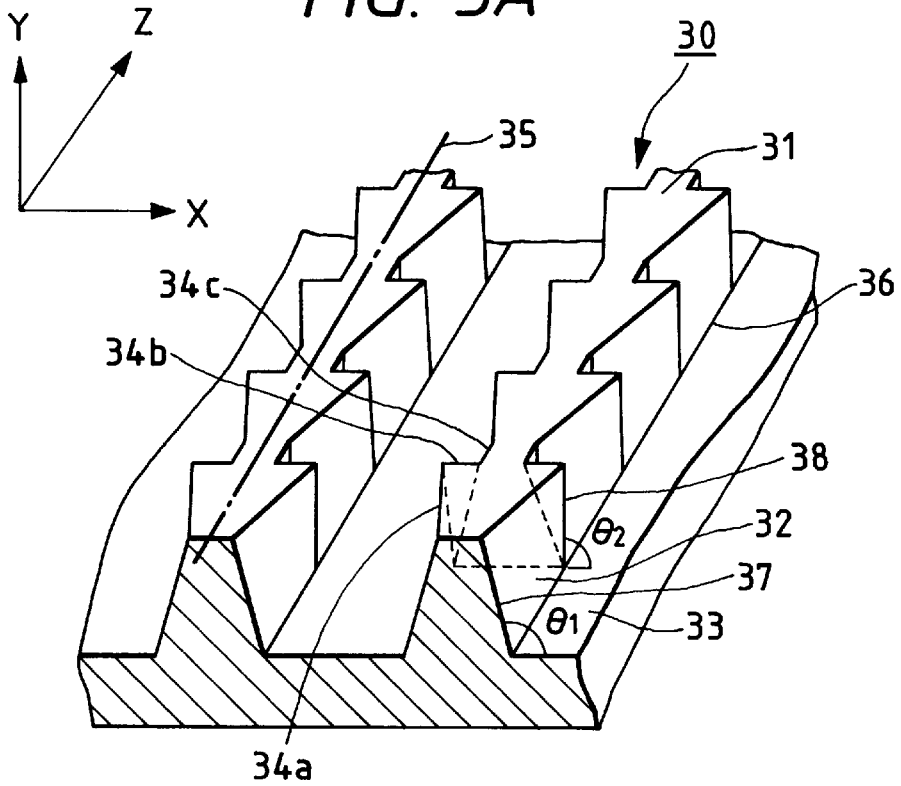
FIG. 3A is a perspective view showing a groove configuration formed on an inside wall of a heat exchanger tube in accordance with a third embodiment of the present invention.
Figure 3B:
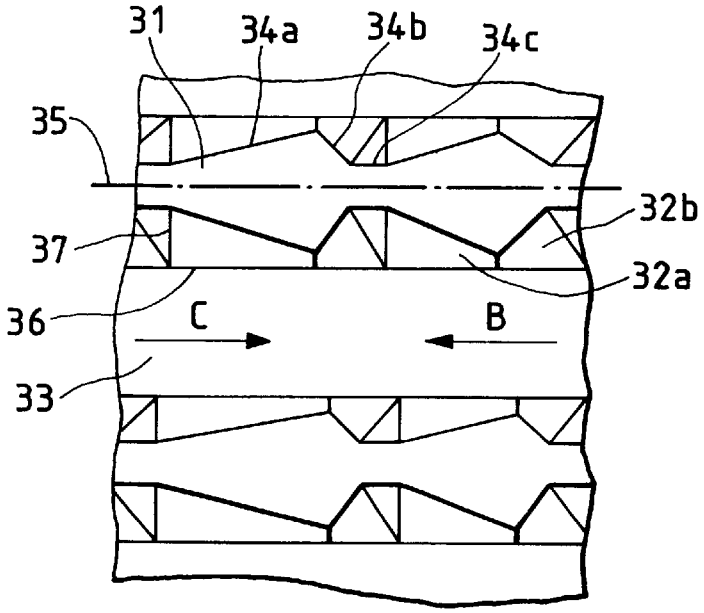
FIG. 3B is a plan view showing the groove configuration of FIG. 3A.

A third embodiment of the present invention will be explained with reference to FIGS. 3A and 3B. FIG. 3A is a perspective view showing a groove configuration formed on an inside wall of a heat exchanger tube in accordance with the third embodiment of the present invention. FIG. 3B is a plan view showing the groove configuration of FIG. 3A.

A plurality of undulated ridges 30, provided on the inside wall of the heat exchanger tube, are aligned in parallel with each other so as to extend in the Z-axis direction of the heat exchanger tube (i.e. the direction of fluid flow).

Each undulated ridge 30 is formed into the same configuration having a top surface 31 and symmetrical side surfaces 32. Top surface 31 is parallel to X-Z plane and extends in Z-axis direction of the heat exchange tube (i.e. the direction of fluid flow).

Each side surface 32, substantially extending in parallel to the Y-Z plane, is undulated with sequentially aligned slant surfaces. Side surface 32 intersects with top surface 31 along a zigzag line (ridge lines 34*a*, 34*b* and 34*c*), while side surface 32 intersects with a bottom (recess) 33 along a straight line (base line 36). Bottom 33 is flat and extends in parallel to the X-Z plane.

More specifically, lateral width (X-direction width) of top surface 31 is gradually changed with respect to a longitudinal center line 35 of ridge 30 (extending in the Z-axis direction of the heat exchanger tube) in a region where top surface 31 and side surface 32 intersect along ridge line 34*a* (i.e. part of the zigzag line). The lateral width of top surface 31 is steeply changed in another region where top surface 31 and side surface 32 intersect along ridge line 34*b*. Furthermore, the lateral width of top surface 31 remains unchanged in a region where top surface 31 and side surface 32 intersect along ridge line 34*c*.

A straight line 37, perpendicular to center line 35, extends from an intersecting point of ridge lines 34*a* and 34*c* to base line 36. Another straight line 38, perpendicular to center line 35, extends from an intersecting point of ridge lines 34*a* and 34*b* to base line 36. Line 37 has a base angle θ1 with respect to bottom 33, while line 38 has a base angle θ2 with respect to bottom 33.

Bottom 33, is parallel to the X-Z plane and extends flatly in the Z-direction, and does not act as substantial resistance to the fluid flow.

Gradual slant side surface 32*a*, defined between each ridge line 34*a* and base line 36, faces against the fluid flow "C" in a condensation phase. On the other hand, steep slant side surface 32*b*, defined between each ridge line 34*b* and base line 36, faces against the fluid flow "B" in a vaporization phase.

When the fluid in the heat exchanger tube is vaporized, fluid flow "B" collides with steep slant side surface 32*b*. Resistance to the fluid flow "B" is fairly large due to steepness of slant side surface 32*b*. Hence, in the vaporization phase of the fluid in the heat exchanger tube, it becomes possible to effectively cause disturbance in the fluid flow "B", increasing pressure loss (i.e. resistance to the fluid flow "B").

On the other hand, when the fluid in the heat exchanger tube is condensed, fluid flow "C" collides with gradual slant side surface 32*a*. Gradualness of slant side surface 32*a* brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the pressure loss (i.e. resistance to the fluid flow "C").

Formation of undulated side surfaces 32 enlarges the wetted area or length, realizing a high efficiency in heat exchange.

As apparent from the foregoing description, the third embodiment of the present invention provides a heat exchanger tube having an inside wall groove configuration whose cross-sectional area normal to the center line thereof varies in such a manner that the increased rate of the cross-sectional area is differentiated from the decreased rate of the cross-sectional area (i.e. the increased rate is always larger than the decreased rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

More specifically, according to the third embodiment, the cross-sectional area of the groove configuration varies in accordance with a change of the top width of a protruding portion constituting part of the groove configuration formed on the inside wall of the heat exchanger tube.

Fourth Embodiment

Figure 4A:
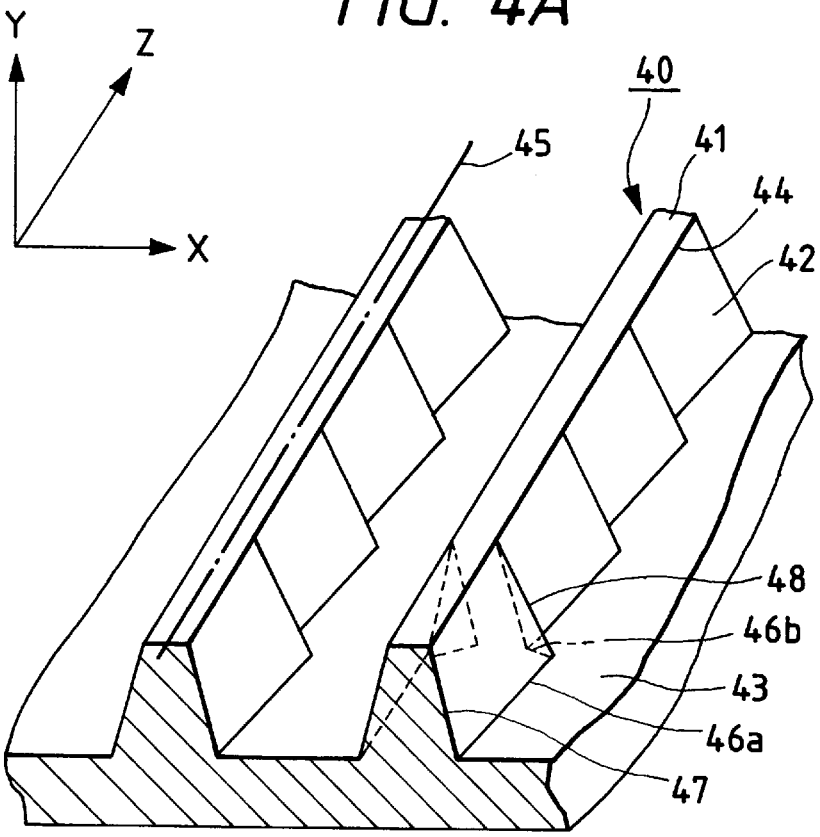
FIG. 4A is a perspective view showing a groove configuration formed on an inside wall of a heat exchanger tube in accordance with a fourth embodiment of the present invention.
Figure 4B:
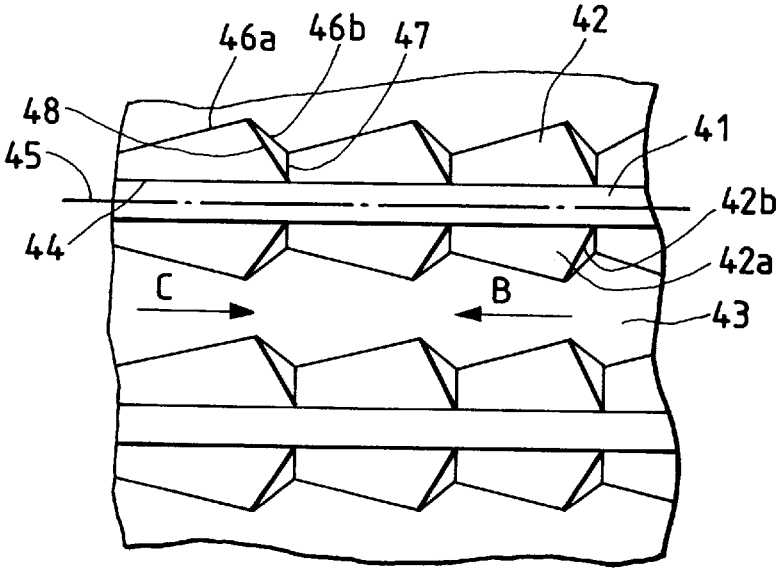
FIG. 4B is a plan view showing the groove configuration of FIG. 4A.

A fourth embodiment of the present invention will be explained with reference to FIGS. 4A and 4B. FIG. 4A is a perspective view showing a groove configuration formed on an inside wall of a heat exchanger tube in accordance with the fourth embodiment of the present invention. FIG. 4B is a plan view showing the groove configuration of FIG. 4A.

A plurality of undulated ridges 40, provided on the inside wall of the heat exchanger tube, are aligned in parallel with each other so as to extend in the Z-axis direction of the heat exchanger tube (i.e. the direction of fluid flow).

Each undulated ridge 40 is formed into the same configuration having a top surface 41 and symmetrical side surfaces 42. Top surface 41, having a constant lateral width, is parallel to X-Z plane and extends in the Z-axis direction of the heat exchange tube (i.e. the direction of fluid flow).

Each side surface 42, substantially extending in parallel to the Y-Z plane, is undulated with sequentially aligned slant surfaces. Side surface 42 intersects with top surface 41 along a straight line (ridge line 44), while side surface 42 intersects with a bottom (recess) 43 along a zigzag line (base lines 46*a* and 46*b*). Bottom 43 is flat and extends in parallel to the X-Z plane.

More specifically, lateral width (X-direction width) of the base of ridge 40 is gradually changed with respect to a longitudinal center line 45 of ridge 40 (extending in the Z-axis direction of the heat exchanger tube) in a region where side surface 42 and bottom 43 intersect along base line 46*a* (i.e. part of the zigzag line). The lateral width of the base of ridge 40 is steeply changed in another region where side surface 42 and bottom 43 intersect along base line 46*b*.

In other words, the lateral width (X-direction width) of bottom 43 is gradually changed in the region where side surface 42 and bottom 43 intersect along base line 46*a*. The lateral width of bottom 43 is steeply changed in the region where side surface 42 and bottom 43 intersect along base line 46*b*.

A straight line 47, perpendicular to center line 45, extends from a concave intersecting point of base lines 46*a* and 46*b* to ridge line 44. Another straight line 48 extends from a convex intersecting point of base lines 46*a* and 46*b* to the intersecting point of lines 47 and 44.

Bottom 43, which is parallel to the X-Z plane and extends flatly in the Z-direction, does not act as substantial resistance to the fluid flow.

Gradual slant side surface 42*a*, defined between each base line 46*a* and ridge line 44, faces against the fluid flow "C" in a condensation phase. On the other hand, steep slant side surface 42*b*, defined between each base line 46*b* and ridge line 44, faces against the fluid flow "B" in a vaporization phase.

When the fluid in the heat exchanger tube is vaporized, fluid flow "B" collides with steep slant side surface 42*b*. Resistance to the fluid flow "B" is fairly large due to the steepness of slant side surface 42*b*. Hence, in the vaporization phase of the fluid in the heat exchanger tube, it becomes possible to effectively cause disturbance in the fluid flow "B", increasing pressure loss (i.e. resistance to the fluid flow "B").

On the other hand, when the fluid in the heat exchanger tube is condensed, fluid flow "C" collides with gradual slant side surface 42*a*. Gradualness of slant side surface 42*a* brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the pressure loss (i.e. resistance to the fluid flow "C").

Formation of undulated side surfaces 42 enlarges the wetted area or length, realizing a high efficiency in heat exchange.

As apparent from the foregoing description, the fourth embodiment of the present invention provides a heat exchanger tube having an inside wall groove configuration whose cross-sectional area normal to the center line thereof varies in such a manner that the increased rate of the cross-sectional area is differentiated from the decreased rate of the cross-sectional area (i.e. the increased rate is always larger than the decreased rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

More specifically, according to the fourth embodiment, the cross-sectional area of the groove configuration varies in accordance with a change of the width of a recessed portion constituting part of the groove configuration formed on the inside wall of the heat exchanger tube.

Fifth Embodiment

Figure 5A:
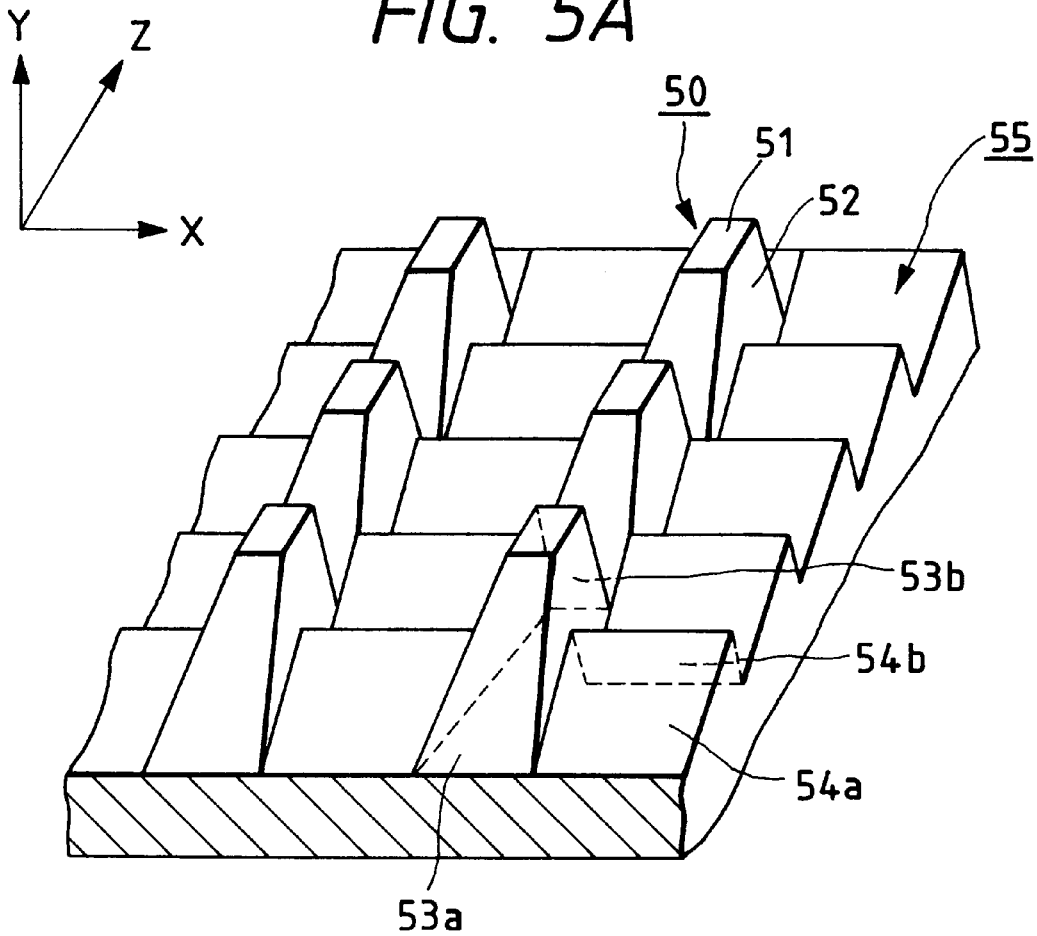
FIG. 5A is a perspective view showing a groove configuration formed on an inside wall of a heat exchanger tube in accordance with a fifth embodiment of the present invention.
Figure 5B:
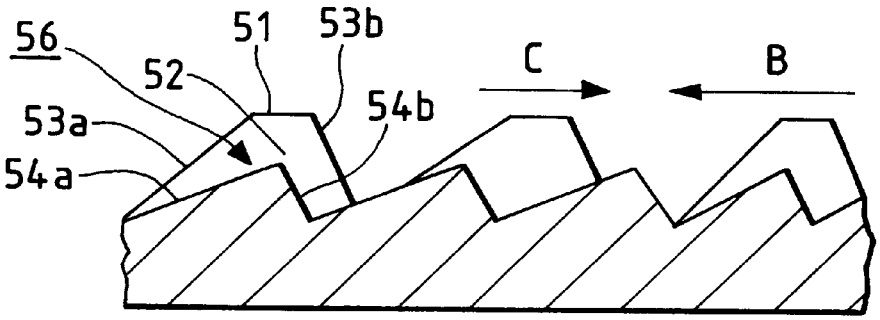
FIG. 5B is a cross-sectional side view showing the groove configuration of FIG. 5A.

A fifth embodiment of the present invention will be explained with reference to FIGS. 5A and 5B. FIG. 5A is a perspective view showing a groove configuration formed on an inside wall of a heat exchanger tube in accordance with the fifth embodiment of the present invention. FIG. 5B is a cross-sectional side view showing the groove configuration of FIG. 5A.

A plurality of protrusions 50 are provided on the inside wall of the heat exchanger tube. These protrusions 50 are identical in configuration and arrangement with protrusions 10 of the first embodiment shown in FIGS. 1A and 1B. That is, plural protrusions 50 are sequentially aligned in plural lines extending in the Z-axis direction of the heat exchanger tube (i.e. the direction of fluid flow).

Each protrusion 50, formed into a truncated pyramid, comprises a top surface 51, two side surfaces 52, a gradual slant surface 53*a*, and a steep slant surface 53*b*. Gradual slant surface 53*a* and steep slant surface 53*b* are opposed each other in the direction of fluid flow (i.e. Z-axis direction of the heat exchanger tube).

Between adjacent two parallel rows consisting of consecutive protrusions 50—50, there is formed an undulated bottom 55 extending in the Z-axis direction of the heat exchanger tube (i.e. the direction of fluid flow).

Undulated bottom 55 is identical in configuration and arrangement with undulated bottom 27 of the second embodiment shown in FIGS. 2A and 2B. That is, undulated bottom 55 comprises a plurality of waves 56. Each wave 56 comprises a gradual slant surface 54*a* and a steep slant surface 54*b* which are alternately aligned in the direction of fluid flow (i.e. the Z-axis direction of heat exchanger tube).

Gradual slant surface 53*a* of protrusion 50 and gradual slant surface 54*a* of wave 56 (i.e. undulated bottom 55) face against the fluid flow "C" in a condensation phase. Steep slant surface 53*b* of protrusion 50 and steep slant surface 54*b* of wave 56 face against the fluid flow "B" in a vaporization phase.

In short, the fifth embodiment is substantially the combination of the first embodiment and the second embodiment, bringing a composite effect of them.

When the fluid in the heat exchanger tube is vaporized, fluid flow "B" collides with steep slant surfaces 53*b* and 54*b*. Resistance to the fluid flow "B" is fairly large due to steepness of slant surfaces 53*b* and 54*b*. Hence, in the vaporization phase of the fluid in the heat exchanger tube, it becomes possible to effectively cause disturbance in the fluid flow "B", increasing the pressure loss (i.e. resistance to the fluid flow "B").

On the other hand, when fluid in the heat exchanger tube is condensed, fluid flow "C" collides with gradual slant surfaces 53*a* and 54*a*. Gradualness of slant surfaces 53*a* and 54*a* brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the resistance to the fluid flow "C".

Formation of side surfaces 52 of ridges 50 enlarges the wetted area or length, realizing a high efficiency in heat exchange.

As apparent from the foregoing description, the fifth embodiment of the present invention provides a heat exchanger tube having an inside wall groove configuration whose cross-sectional area normal to the center line thereof varies in such a manner that the increased rate of the cross-sectional area is differentiated from the decreased rate of the cross-sectional area (i.e. the increased rate is always larger than the decreased rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

More specifically, according to the fifth embodiment, the cross-sectional area of the groove configuration varies in accordance with a change of the height of a protruding portion and also varies in accordance with a change of the depth of a recessed portion, the protruding portion and the recessed portion respectively constituting part of the groove configuration.

Sixth Embodiment

Figure 6A:
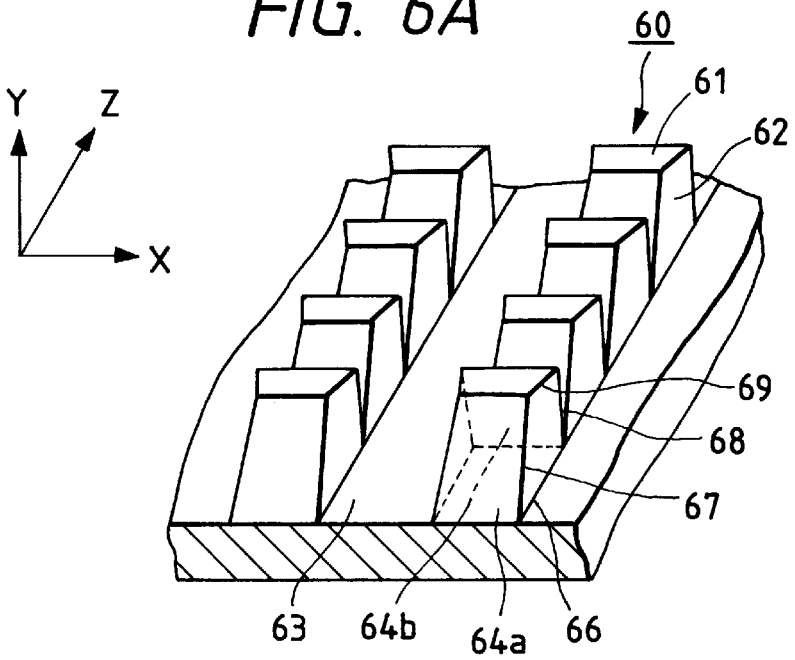
FIG. 6A is a perspective view showing a groove configuration formed on an inside wall of a heat exchanger tube in accordance with a sixth embodiment of the present invention.
Figure 6B:
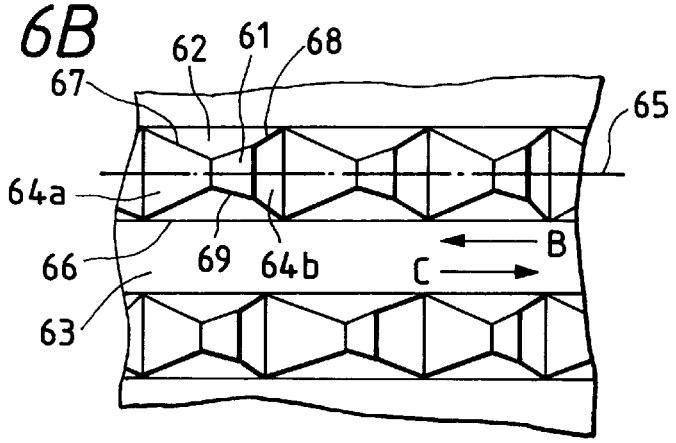
FIG. 6B is a plan view showing the groove configuration of FIG. 6A.
Figure 6C:
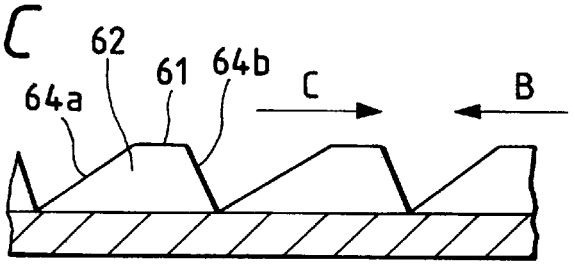
FIG. 6C is a cross-sectional side view showing the groove configuration of FIG. 6A.

A sixth embodiment of the present invention will be explained with reference to FIGS. 6A through 6C. FIG. 6A is a perspective view showing a groove configuration formed on an inside wall of a heat exchanger tube in accordance with the sixth embodiment of the present invention. FIG. 6B is a plan view showing the groove configuration of FIG. 6A. FIG. 6C is a cross-sectional side view showing the groove configuration of FIG. 6A.

A plurality of protrusions 60 are provided on the inside wall of the heat exchanger tube. These protrusions 60 are sequentially aligned in plural lines extending in the Z-axis direction of the heat exchanger tube (i.e. the direction of fluid flow).

Each protrusion 60, formed into the same configuration similar to a truncated pyramid but slightly different from the protrusion 10 of the first embodiment shown in FIGS. 1A and 1B, comprises a top surface 61, two side surfaces 62, a gradual slant surface 64*a*, and a steep slant surface 64*b*. Gradual slant surface 64*a* and steep slant surface 64*b* are opposed each other in the direction of fluid flow (i.e. Z-axis direction of the heat exchanger tube).

Between adjacent two parallel rows consisting of consecutive protrusions 60—60, there is formed a flat bottom 63 extending in the Z-axis direction of the heat exchanger tube (i.e. the direction of fluid flow).

Top surface 61, extending in parallel with X-Z plane, has a lateral (X-direction) width gradually changing with respect to a longitudinal center line 65 of protrusion 60. A ridge line 69, along which side surface 62 intersects with top surface 61, is inclined with respect to the center line 65 at a gradual angle. A base line 66 of protrusion 60, along which side surface 62 intersects with bottom 63, extends straight in parallel with center line 65.

Gradual slant surface 64*a* intersects with side surface 62 along a straight line 67, while steep slant surface 64*b* intersects with side surface 62 along a straight line 68.

Each side surface 62, defined between ridge line 69 and base line 66, is a gradual slant surface slightly inclined with respect to the direction of fluid flow (i.e. Z-direction).

Gradual slant surface 64*a* and side surface 62 face against the fluid flow "C" in a condensation phase. On the other hand, steep slant surface 64*b* faces against the fluid flow "B" in a vaporization phase.

In short, the sixth embodiment is substantially the combination of the first embodiment and the third embodiment, bringing a composite effect of them.

When the fluid in the heat exchanger tube is vaporized, fluid flow "B" collides with steep slant surface 64*b*. Resistance to the fluid flow "B" is fairly large due to steepness of slant surface 64*b*. Hence, in the vaporization phase of the fluid in the heat exchanger tube, it becomes possible to effectively cause disturbance in the fluid flow "B", increasing the pressure loss (i.e. resistance to the fluid flow "B").

On the other hand, when fluid in the heat exchanger tube is condensed, fluid flow "C" collides with gradual slant surfaces 64*a* and 62. Gradualness of slant surfaces 64*a* and 62 brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the resistance to the fluid flow "C".

Formation of side surfaces 62 of protrusions 60 enlarges the wetted area or length, realizing a high efficiency in heat exchange.

As apparent from the foregoing description, the sixth embodiment of the present invention provides a heat exchanger tube having an inside wall groove configuration whose cross-sectional area normal to the center line thereof varies in such a manner that the increased rate of the cross-sectional area is differentiated from the decreased rate of the cross-sectional area (i.e. the increased rate is always larger than the decreased rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

More specifically, according to the sixth embodiment, the cross-sectional area of the groove configuration varies in accordance with a change of the height of a protruding portion and also varies in accordance with a change of the width of the protruding portion, the protruding portion constituting part of the groove configuration.

Seventh Embodiment

Figure 7A:
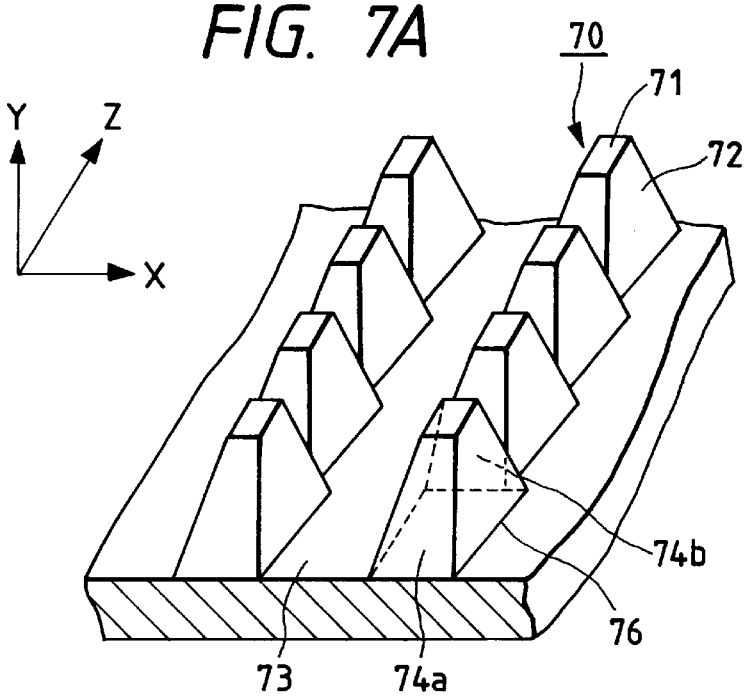
FIG. 7A is a perspective view showing a groove configuration formed on an inside wall of a heat exchanger tube in accordance with a seventh embodiment of the present invention.
Figure 7B:
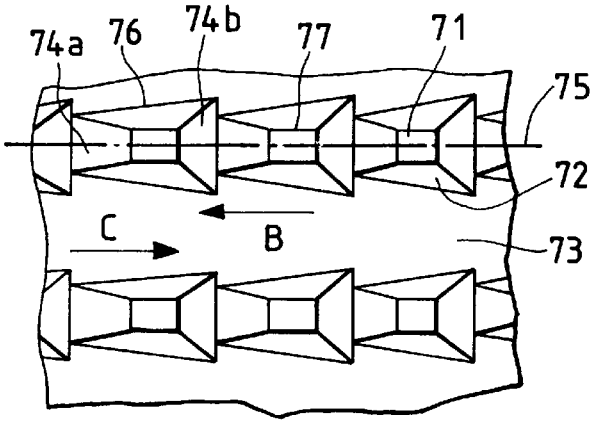
FIG. 7B is a plan view showing the groove configuration of FIG. 7A.
Figure 7C:
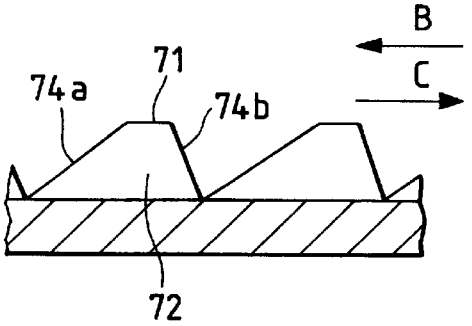
FIG. 7C is a cross-sectional side view showing the groove configuration of FIG. 7A.

A seventh embodiment of the present invention will be explained with reference to FIGS. 7A through 7C. FIG. 7A is a perspective view showing a groove configuration formed on an inside wall of a heat exchanger tube in accordance with the seventh embodiment of the present invention. FIG. 7B is a plan view showing the groove configuration of FIG. 7A. FIG. 7C is a cross-sectional side view showing the groove configuration of FIG. 7A.

A plurality of protrusions 70 are provided on the inside wall of the heat exchanger tube. These protrusions 70 are sequentially aligned in plural lines extending in the Z-axis direction of the heat exchanger tube (i.e. the direction of fluid flow).

Each protrusion 70, formed into the same configuration similar to a truncated pyramid but slightly different from the protrusion 10 of the first embodiment shown in FIGS. 1A and 1B, comprises a top surface 71, two side surfaces 72, a gradual slant surface 74*a*, and a steep slant surface 74*b*. Gradual slant surface 74*a* and steep slant surface 74*b* are opposed each other in the direction of fluid flow (i.e. Z-axis direction of the heat exchanger tube).

Between adjacent two parallel rows consisting of consecutive protrusions 70—70, there is formed a flat bottom 73 extending in the Z-axis direction of the heat exchanger tube (i.e. the direction of fluid flow).

Top surface 71, extending in parallel with X-Z plane, has a constant lateral (X-direction) width. A ridge line 77, along which side surface 72 intersects with top surface 71, is straight and extends in parallel with a longitudinal center line 75 of protrusion 70. A base line 76 of protrusion 70, along which side surface 72 intersects with bottom 73, is slightly inclined with respect to the center line 75 at a gradual angle.

Each side surface 72, defined between ridge line 77 and base line 76, is a gradual slant surface slightly inclined with respect to the direction of fluid flow (i.e. Z-axis direction).

Gradual slant surface 74*a* and side surface 72 face against the fluid flow "C" in a condensation phase. On the other hand, steep slant surface 74*b* faces against the fluid flow "B" in a vaporization phase.

In short, the seventh embodiment is substantially the combination of the first embodiment and the fourth embodiment, bringing a composite effect of them.

When the fluid in the heat exchanger tube is vaporized, fluid flow "B" collides with steep slant surface 74*b*. Resistance to the fluid flow "B" is fairly large due to steepness of slant surface 74*b*. Hence, in the vaporization phase of the fluid in the heat exchanger tube, it becomes possible to effectively cause disturbance in the fluid flow "B", increasing the pressure loss (i.e. resistance to the fluid flow "B").

On the other hand, when fluid in the heat exchanger tube is condensed, fluid flow "C" collides with gradual slant surfaces 74*a* and 72. Gradualness of slant surfaces 74*a* and 72 brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the resistance to the fluid flow "C".

Formation of side surfaces 72 of protrusions 70 enlarges the wetted area or length, realizing a high efficiency in heat exchange.

As apparent from the foregoing description, the seventh embodiment of the present invention provides a heat exchanger tube having an inside wall groove configuration whose cross-sectional area normal to the center line thereof varies in such a manner that the increased rate of the cross-sectional area is differentiated from the decreased rate of the cross-sectional area (i.e. the increased rate is always larger than the decreased rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

More specifically, according to the seventh embodiment, the cross-sectional area of the groove configuration varies in accordance with a change of the height of a protruding portion and also varies in accordance with a change of the width of a recessed portion, the protruding portion and the recessed portion respectively constituting part of the groove configuration.

Eighth Embodiment

Figure 8A:
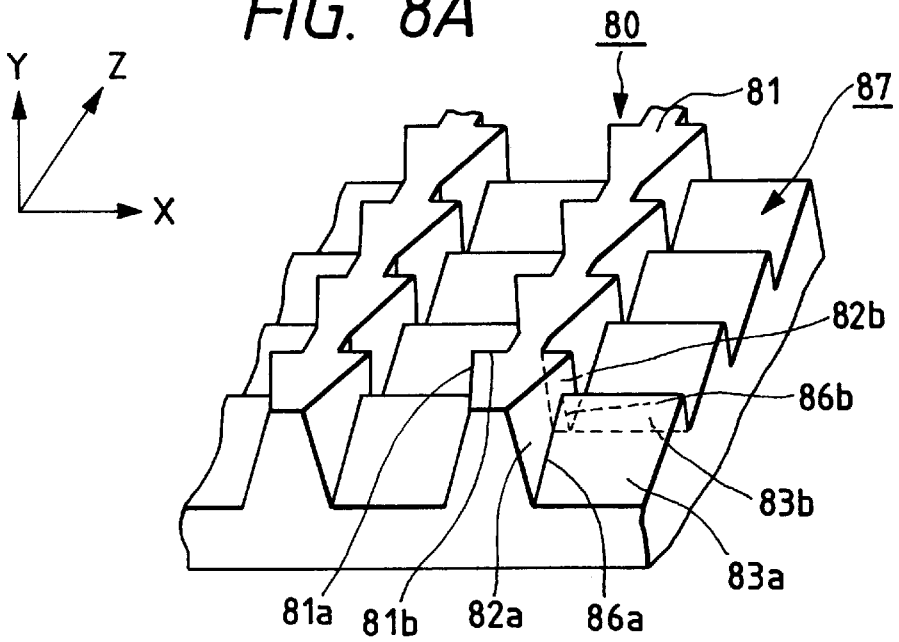
FIG. 8A is a perspective view showing a groove configuration formed on an inside wall of a heat exchanger tube in accordance with an eighth embodiment of the present invention.
Figure 8B:
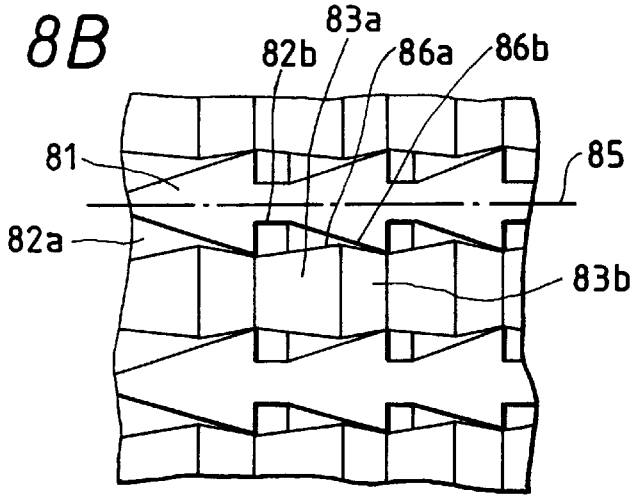
FIG. 8B is a plan view showing the groove configuration of FIG. 8A.
Figure 8C:
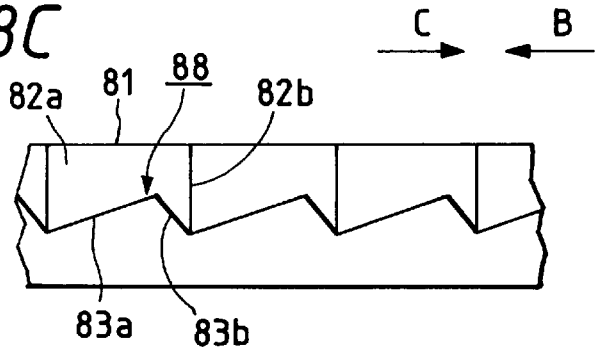
FIG. 8C is a cross-sectional side view showing the groove configuration of FIG. 8A.

An eighth embodiment of the present invention will be explained with reference to FIGS. 8A through 8C. FIG. 8A is a perspective view showing a groove configuration formed on an inside wall of a heat exchanger tube in accordance with the eighth embodiment of the present invention. FIG. 8B is a plan view showing the groove configuration of FIG. 8A. FIG. 8C is a cross-sectional side view showing the groove configuration of FIG. 8A.

A plurality of undulated ridges 80, provided on the inside wall of the heat exchanger tube, are aligned in parallel with each other so as to extend in the Z-axis direction of the heat exchanger tube (i.e. the direction of fluid flow). These undulated ridges 80 are substantially identical in configuration and arrangement with undulated ridges 30 of the third embodiment shown in FIGS. 3A and 3B. Namely, each ridge 80 is formed into the same configuration having a top surface 81 and symmetrical side surfaces 82*a*, 82*b*. Top surface 81 is parallel to X-Z plane and extends in the Z-axis direction of the heat exchange tube (i.e. the direction of fluid flow).

Side surfaces 82*a* and 82*b*, which are sequentially and alternately aligned surfaces, intersect with top surface 81 along a zigzag line (ridge lines 81*a* and 81*b*). Side surfaces 82*a* and 82*b* intersect with an undulated bottom 87 along a zigzag line (base lines 86*a* and 86*b*).

More specifically, lateral width (X-direction width) of top surface 81 is gradually changed with respect to the Z-axis direction of the heat exchanger tube in a region where top surface 81 and side surface 82*a* intersect along ridge line 81*a* (i.e. part of the zigzag line). The lateral width of top surface 81 is steeply changed in another region where top surface 81 and side surface 82*b* intersect along ridge line 81*b*.

Side surface 82*a*, defined between ridge line 81*a* and base line 86*a*, is a slant surface inclined at a gradual angle with respect to the direction of fluid flow. Side surface 82*b*, defined between ridge line 81*b* and base line 86*b*, is normal to the direction of fluid flow.

Between adjacent two parallel ridges 80 and 80, there is formed an undulated bottom 87 extending in the Z-axis direction of the heat exchanger tube (i.e. the direction of fluid flow).

Undulated bottom 87 is identical in configuration and arrangement with undulated bottom 27 of the second embodiment shown in FIGS. 2A and 2B. That is, undulated bottom 87 comprises a plurality of waves 88. Each wave 88 comprises a gradual slant surface 83*a* and a steep slant surface 83*b* which are alternately aligned in the direction of fluid flow (i.e. the Z-axis direction of the heat exchanger tube).

Gradual slant surface 82*a* of ridge 80 and gradual slant surface 83*a* of wave 88 (i.e. undulated bottom 87) face against the fluid flow "C" in a condensation phase. Steep surface 82*b* of ridge 80 and steep slant surface 83*b* of wave 88 face against the fluid flow "B" in a vaporization phase.

In short, the eighth embodiment is substantially the combination of the second embodiment and the third embodiment, bringing a composite effect of them.

When the fluid in the heat exchanger tube is vaporized, fluid flow "B" collides with steep surfaces 82*b* and 83*b*. Resistance to the fluid flow "B" is fairly large due to steepness of surfaces 82*b* and 83*b*. Hence, in the vaporization phase of the fluid in the heat exchanger tube, it becomes possible to effectively cause disturbance in the fluid flow "B", increasing the pressure loss (i.e. resistance to the fluid flow "B").

On the other hand, when fluid in the heat exchanger tube is condensed, fluid flow "C" collides with gradual slant surfaces 82*a* and 83*a*. Gradualness of slant surfaces 82*a* and 83*a* brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the resistance to the fluid flow "C".

Formation of side surfaces 82*a* and 82*b* of ridges 80 enlarges the wetted area or length, realizing a high efficiency in heat exchange.

As apparent from the foregoing description, the eighth embodiment of the present invention provides a heat exchanger tube having an inside wall groove configuration whose cross-sectional area normal to the center line thereof varies in such a manner that the increased rate of the cross-sectional area is differentiated from the decreased rate of the cross-sectional area (i.e. the increased rate is always larger than the decreased rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

More specifically, according to the eighth embodiment, the cross-sectional area of the groove configuration varies in accordance with a change of the depth of a recessed portion and also varies in accordance with a change of the width of a protruding portion, the recessed portion and the protruding portion respectively constituting part of the groove configuration.

Ninth Embodiment

Figure 9A:
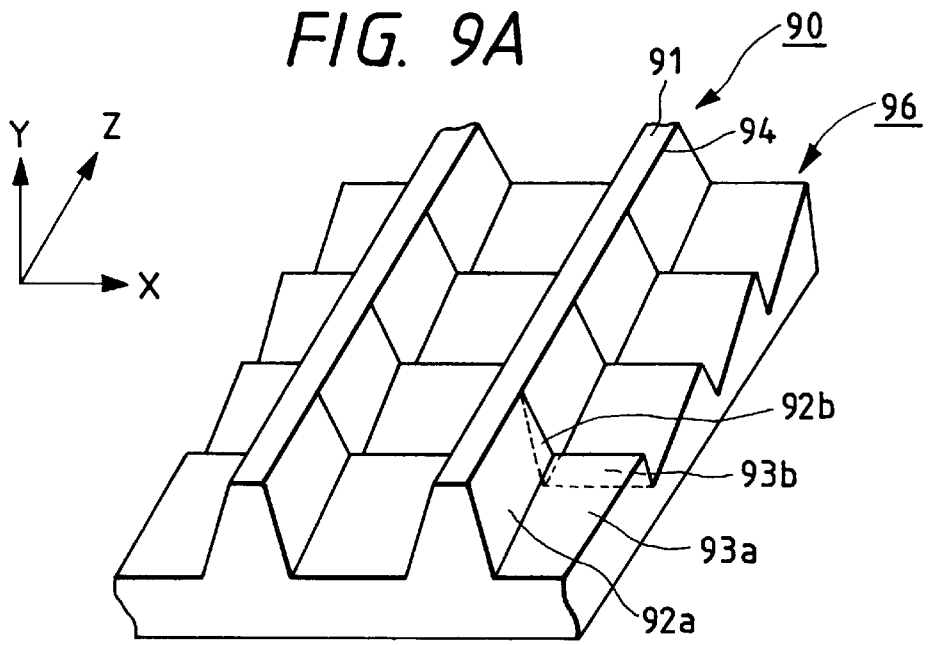
FIG. 9A is a perspective view showing a groove configuration formed on an inside wall of a heat exchanger tube in accordance with a ninth embodiment of the present invention.
Figure 9B:
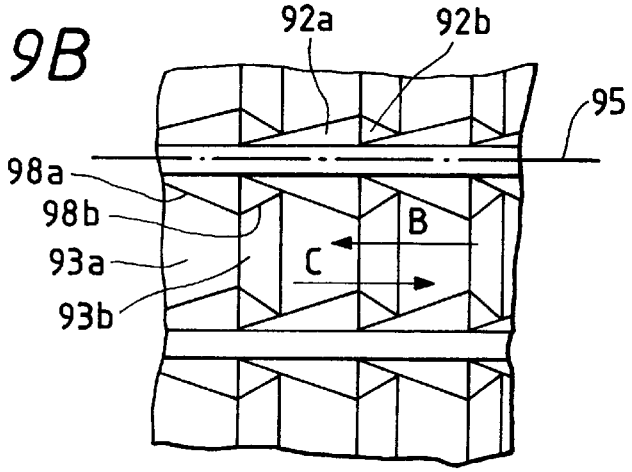
FIG. 9B is a plan view showing the groove configuration of FIG. 9A.
Figure 9C:
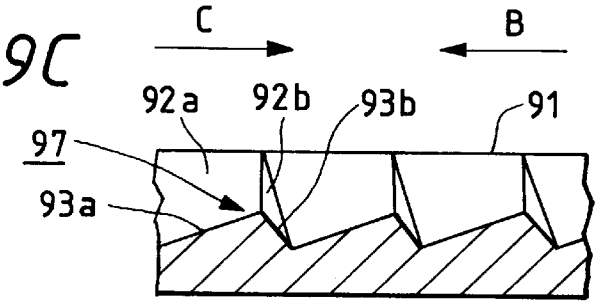
FIG. 9C is a cross-sectional side view showing the groove configuration of FIG. 9A.

A ninth embodiment of the present invention will be explained with reference to FIGS. 9A through 9C. FIG. 9A is a perspective view showing a groove configuration formed on an inside wall of a heat exchanger tube in accordance with the ninth embodiment of the present invention. FIG. 9B is a plan view showing the groove configuration of FIG. 9A. FIG. 9C is a cross-sectional side view showing the groove configuration of FIG. 9A.

A plurality of undulated ridges 90, provided on the inside wall of the heat exchanger tube, are aligned in parallel with each other so as to extend in the Z-axis direction of the heat exchanger tube (i.e. the direction of fluid flow). These undulated ridges 90 are substantially identical in configuration and arrangement with undulated ridges 40 of the fourth embodiment shown in FIGS. 4A and 4B. Namely, each ridge 90 is formed into the same configuration having a top surface 91 and symmetrical side surfaces 92*a*, 92*b*. Top surface 91, having a constant lateral width, is parallel to X-Z plane and extends in the Z-axis direction of the heat exchange tube (i.e. the direction of fluid flow).

Side surfaces 92*a* and 92*b*, which are sequentially and alternately aligned surfaces, intersect with top surface 91 along a straight line (ridge line 94). Side surfaces 92*a* and 92*b* intersect with an undulated bottom 96 along a zigzag line (base lines 98*a* and 98*b*). Lateral width (X-direction width) of the base of ridge 90 is gradually changed with respect to a center line 95 of ridge 90 (extending in the Z-axis direction of the heat exchanger tube) in a region where side surface 92*a* and gradual slant surface 93*a* of bottom 96 intersect along base line 98*a* (i.e. part of the zigzag line). The lateral width of the base of ridge 90 is steeply changed in another region where side surface 92*b* and steep slant surface 93*b* of bottom 96 intersect along base line 98*b*.

Gradual slant side surface 92*a*, defined between each base line 98*a* and ridge line 94, faces against the fluid flow "C" in a condensation phase. On the other hand, steep slant side surface 92*b*, defined between each base line 98*b* and ridge line 94, faces against the fluid flow "B" in a vaporization phase.

Between adjacent two parallel ridges 90 and 90, there is formed an undulated bottom 96 extending in the Z-axis direction of the heat exchanger tube (i.e. the direction of fluid flow).

Undulated bottom 96 is identical in configuration and arrangement with undulated bottom 27 of the second embodiment shown in FIGS. 2A and 2B. That is, undulated bottom 96 comprises a plurality of waves 97. Each wave 97 comprises a gradual slant surface 93*a* and a steep slant surface 93*b*.

Gradual slant surface 92*a* of ridge 90 and gradual slant surface 93*a* of wave 97 (i.e. undulated bottom 96) face against the fluid flow "C" in a condensation phase. Steep slant surface 92*b* of ridge 90 and steep slant surface 93*b* of wave 97 face against the fluid flow "B" in a vaporization phase.

In short, the ninth embodiment is substantially the combination of the second embodiment and the fourth embodiment, bringing a composite effect of them.

When the fluid in the heat exchanger tube is vaporized, fluid flow "B" collides with steep slant surfaces 92*b* and 93*b*. Resistance to the fluid flow "B" is fairly large due to steepness of slant surfaces 92*b* and 93*b*. Hence, in the vaporization phase of the fluid in the heat exchanger tube, it becomes possible to effectively cause disturbance in the fluid flow "B", increasing the pressure loss (i.e. resistance to the fluid flow "B").

On the other hand, when fluid in the heat exchanger tube is condensed, fluid flow "C" collides with gradual slant surfaces 92*a* and 93*a*. Gradualness of slant surfaces 92*a* and 93*a* brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the resistance to the fluid flow "C".

Formation of side surfaces 92*a* and 92*b* of ridges 90 enlarges the wetted area or length, realizing a high efficiency in heat exchange.

As apparent from the foregoing description, the ninth embodiment of the present invention provides a heat exchanger tube having an inside wall groove configuration whose cross-sectional area normal to the center line thereof varies in such a manner that the increased rate of the cross-sectional area is differentiated from the decreased rate of the cross-sectional area (i.e. the increased rate is always larger than the decreased rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

More specifically, according to the ninth embodiment, the cross-sectional area of the groove configuration varies in accordance with a change of the depth of a recessed portion and also varies in accordance with a change of the width of the recessed portion, the recessed portion constituting part of the groove configuration.

Tenth Embodiment

Figure 10A:
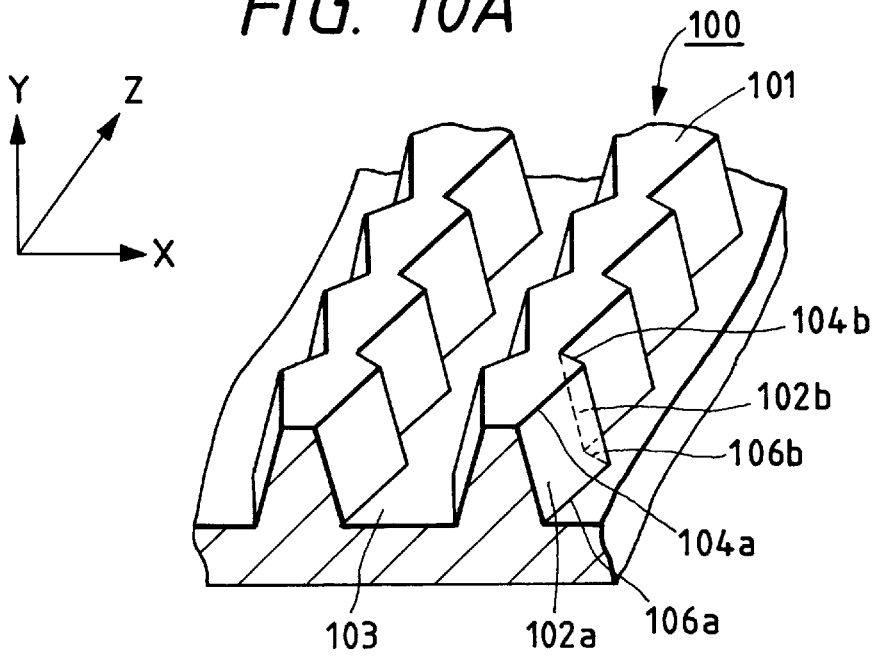
FIG. 10A is a perspective view showing a groove configuration formed on an inside wall of a heat exchanger tube in accordance with a tenth embodiment of the present invention.
Figure 10B:
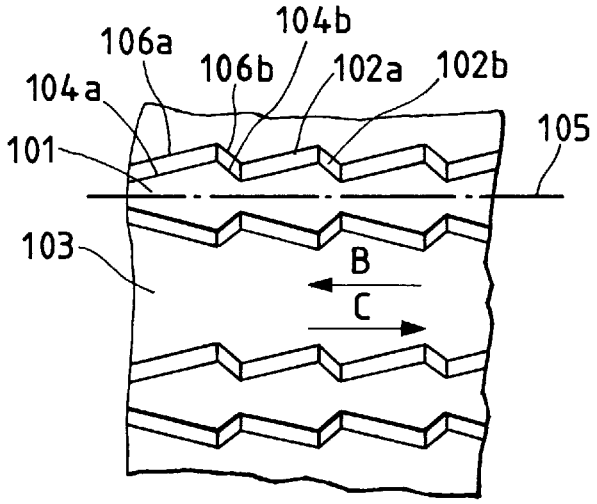
FIG. 10B is a plan view showing the groove configuration of FIG. 10A.
Figure 10C:
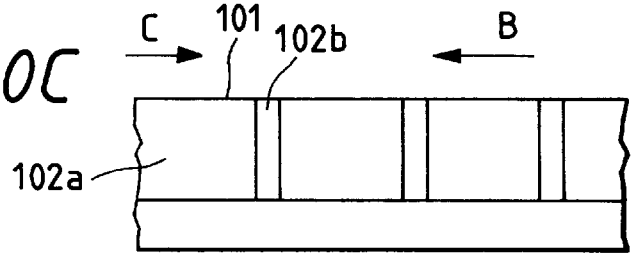
FIG. 10C is a side view showing the groove configuration of FIG. 10A.

A tenth embodiment of the present invention will be explained with reference to FIGS. 10A through 10C. FIG. 10A is a perspective view showing a groove configuration formed on an inside wall of a heat exchanger tube in accordance with the tenth embodiment of the present invention. FIG. 10B is a plan view showing the groove configuration of FIG. 10A. FIG. 10C is a side view showing the groove configuration of FIG. 10A.

A plurality of undulated ridges 100, provided on the inside wall of the heat exchanger tube, are aligned in parallel with each other so as to extend in the Z-axis direction of the heat exchanger tube (i.e. the direction of fluid flow).

Each undulated ridge 100 is formed into the same configuration having a top surface 101 and symmetrical side surfaces 102*a*, 102*b*. Top surface 101 is parallel to X-Z plane and extends in the Z-axis direction of the heat exchange tube (i.e. the direction of fluid flow).

Side surfaces 102*a* and 102*b*, which are sequentially and alternately aligned slant surfaces, intersect with top surface 101 along an upper zigzag line (ridge lines 104*a* and 104*b*). Side surfaces 102*a* and 1102*a* intersect with a bottom 103 along a lower zigzag line (base lines 106*a* and 106*b*). Bottom 103 is flat and extends in parallel to the X-Z plane.

More specifically, lateral width (X-direction width) of top surface 101 is gradually changed with respect to a center line 105 of ridge 100 (extending in the Z-axis direction of the heat exchanger tube) in a region where top surface 101 and side surface 102*a* intersect along ridge line 104*a* (i.e. part of the upper zigzag line). The lateral width of top surface 101 is steeply changed in another region where top surface 101 and side surface 102*a* intersect along ridge line 104*b*.

Gradual slant side surface 102*a*, defined between each ridge line 104*a* and corresponding base line 106*a*, faces against the fluid flow "C" in a condensation phase. On the other hand, steep slant side surface 102*b*, defined between each ridge line 104*b* and corresponding base line 106*b*, faces against the fluid flow "B" in a vaporization phase.

In short, the tenth embodiment is substantially the combination of the third embodiment and the fourth embodiment, bringing a composite effect of them.

When the fluid in the heat exchanger tube is vaporized, fluid flow "B" collides with steep slant surface 102*b*. Resistance to the fluid flow "B" is fairly large due to steepness of slant surface 102*b*. Hence, in the vaporization phase of the fluid in the heat exchanger tube, it becomes possible to effectively cause disturbance in the fluid flow "B", increasing the pressure loss (i.e. resistance to the fluid flow "B").

On the other hand, when fluid in the heat exchanger tube is condensed, fluid flow "C" collides with gradual slant surface 102*a*. Gradualness of slant surface 102*a* brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the resistance to the fluid flow "C".

Formation of side surfaces 102*a* and 102*a* of ridges 100 enlarges the wetted area or length, realizing a high efficiency in heat exchange.

As apparent from the foregoing description, the tenth embodiment of the present invention provides a heat exchanger tube having an inside wall groove configuration whose cross-sectional area normal to the center line thereof varies in such a manner that the increased rate of the cross-sectional area is differentiated from the decreased rate of the cross-sectional area (i.e. the increased rate is always larger than the decreased rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

More specifically, according to the tenth embodiment, the cross-sectional area of the groove configuration varies in accordance with a change of the top width of a protruding portion and also varies in accordance with a change of the width of a recessed portion, the protruding portion and the recessed portion respectively constituting part of the groove configuration.

Eleventh Embodiment

Figure 11A:
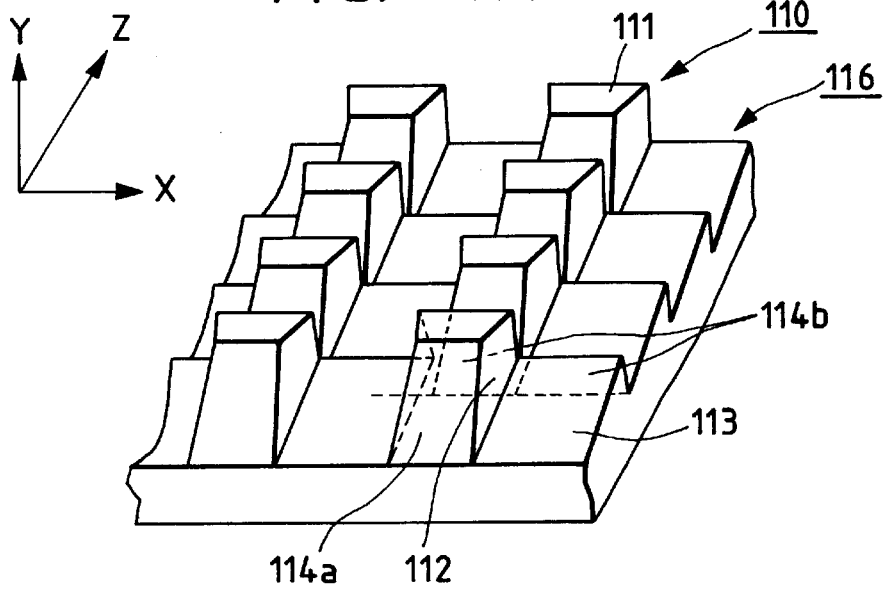
FIG. 11A is a perspective view showing a groove configuration formed on an inside wall of a heat exchanger tube in accordance with an eleventh embodiment of the present invention.
Figure 11B:
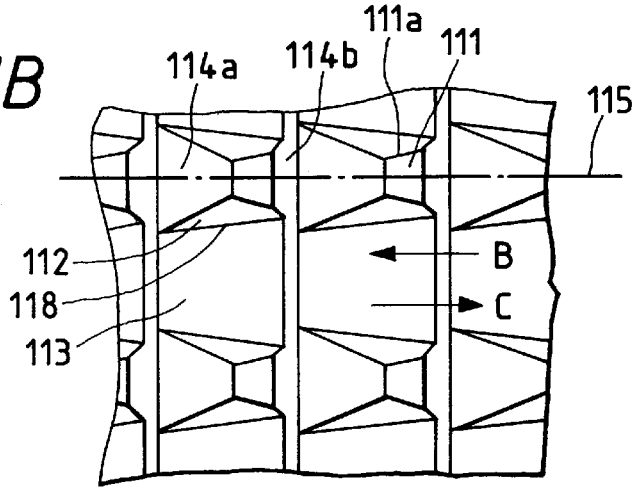
FIG. 11B is a plan view showing the groove configuration of FIG. 11A.
Figure 11C:
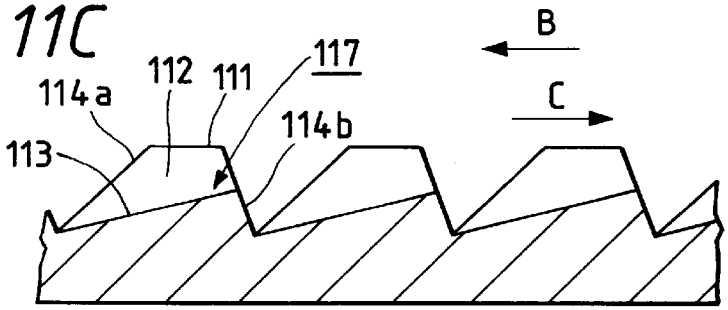
FIG. 11C is a cross-sectional side view showing the groove configuration of FIG. 11A.

An eleventh embodiment of the present invention will be explained with reference to FIGS. 11A through 11C. FIG. 11A is a perspective view showing a groove configuration formed on an inside wall of a heat exchanger tube in accordance with the eleventh embodiment of the present invention. FIG. 11B is a plan view showing the groove configuration of FIG. 11A. FIG. 11C is a cross-sectional side view showing the groove configuration of FIG. 11A.

A plurality of protrusions 110 are provided on the inside wall of the heat exchanger tube. These protrusions 110 are sequentially aligned in plural lines extending in the Z-axis direction of the heat exchanger tube (i.e. the direction of fluid flow).

Each protrusion 110, formed into the same configuration as protrusion 60 of the sixth embodiment shown in FIGS. 6A to 6C, comprises a top surface 111, two side surfaces 112, a gradual slant surface 114*a*, and a steep slant surface 114*b*.

Top surface 111, extending in parallel with X-Z plane, has a lateral (X-direction) width gradually changing with respect to a longitudinal center line 115 of protrusion 110. A ridge line 111*a*, along which side surface 112 intersects with top surface 111, is inclined with respect to the center line 115 at a gradual angle. Each side surface 112, defined between ridge line 111*a* and base line 118, is a gradual slant surface slightly inclined with respect to the direction of fluid flow (i.e. Z-direction).

Between adjacent two parallel rows consisting of consecutive protrusions 110—110, there is formed an undulated bottom 116 extending in the Z-axis direction of the heat exchanger tube (i.e. the direction of fluid flow). Undulated bottom 116 is identical in configuration and arrangement with the undulated bottom 27 of the second embodiment shown in FIGS. 2A and 2B.

Undulated bottom 116 comprises consecutive waves 117 each consisting of a gradual slant surface 113 and steep slant surface 114*b*. The steep slant surface 114*b* forms a common steep slant surface laterally extending from protrusion 110 and adjacent wave 117. Side surface 112 intersects with gradual slant surface 113 along base line 118.

Gradual slant surface 114*a* and slant side surface 112 face against the fluid flow "C" in a condensation phase. On the other hand, steep slant surface 114*b* faces against the fluid flow "B" in a vaporization phase.

In short, the eleventh embodiment is substantially the combination of the first embodiment, the second embodiment and the third embodiment, bringing a composite effect of them.

When the fluid in the heat exchanger tube is vaporized, fluid flow "B" collides with steep slant surface 114*b*. Resistance to the fluid flow "B" is fairly large due to steepness of slant surface 114*b*. Hence, in the vaporization phase of the fluid in the heat exchanger tube, it becomes possible to effectively cause disturbance in the fluid flow "B", increasing the pressure loss (i.e. resistance to the fluid flow "B").

On the other hand, when fluid in the heat exchanger tube is condensed, fluid flow "C" collides with gradual slant surfaces 114*a* and 112. Gradualness of slant surfaces 114*a* and 112 brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the resistance to the fluid flow "C".

Formation of side surfaces 112 of protrusions 110 enlarges the wetted area or length, realizing a high efficiency in heat exchange.

As apparent from the foregoing description, the eleventh embodiment of the present invention provides a heat exchanger tube having an inside wall groove configuration whose cross-sectional area normal to the center line thereof varies in such a manner that the increased rate of the cross-sectional area is differentiated from the decreased rate of the cross-sectional area (i.e. the increase rate is always larger than the decrease rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

More specifically, according to the eleventh embodiment, the cross-sectional area of the groove configuration varies in accordance with a change of the height and the top width of a protruding portion and also varies in accordance with a change of the depth of a recessed portion, the protruding portion and the recessed portion respectively constituting part of the groove configuration.

Twelfth Embodiment

Figure 12A:
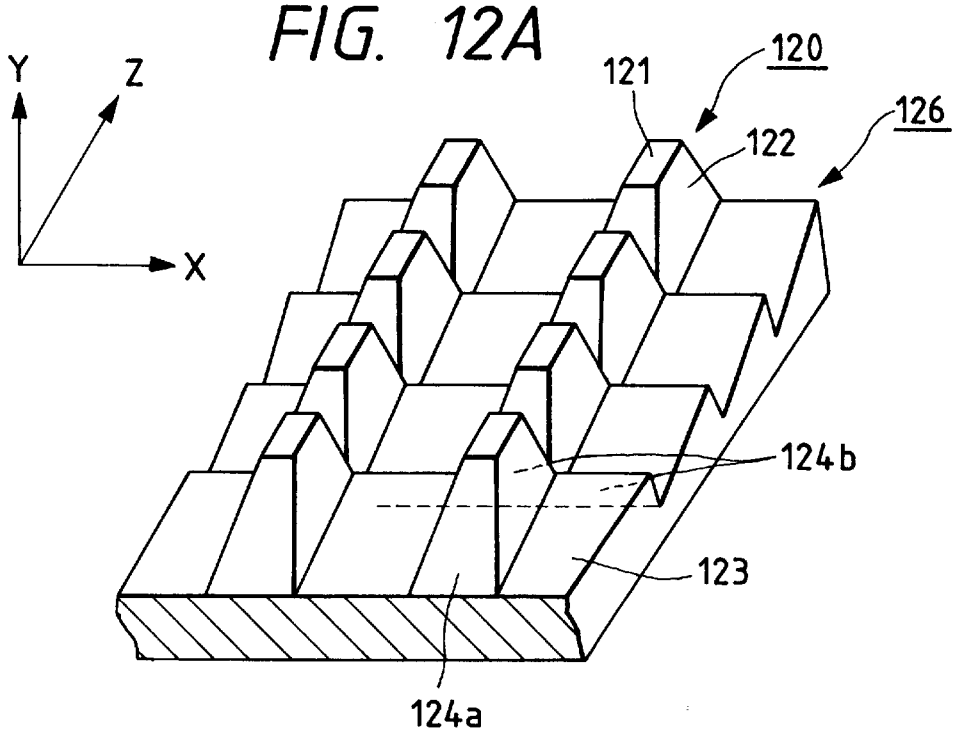
FIG. 12A is a perspective view showing a groove configuration formed on an inside wall of a heat exchanger tube in accordance with a twelfth embodiment of the present invention.
Figure 12B:
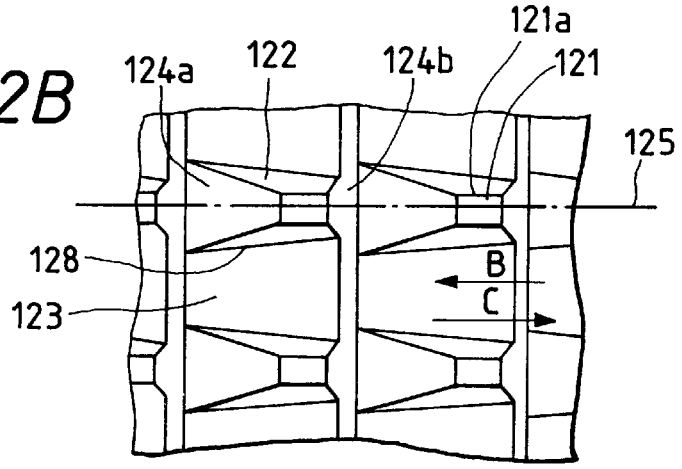
FIG. 12B is a plan view showing the groove configuration of FIG. 12A.
Figure 12C:
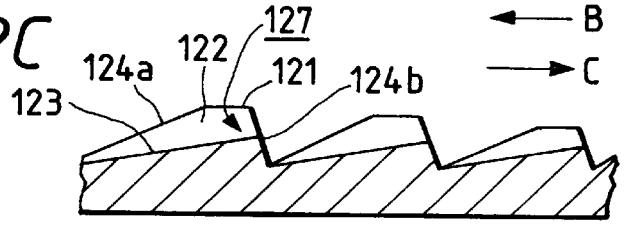
FIG. 12C is a cross-sectional side view showing the groove configuration of FIG. 12A.

A twelfth embodiment of the present invention will be explained with reference to FIGS. 12A through 12C. FIG. 12A is a perspective view showing a groove configuration formed on an inside wall of a heat exchanger tube in accordance with the twelfth embodiment of the present invention. FIG. 12B is a plan view showing the groove configuration of FIG. 12A. FIG. 12C is a cross-sectional side view showing the groove configuration of FIG. 12A.

A plurality of protrusions 120 are provided on the inside wall of the heat exchanger tube. These protrusions 120 are sequentially aligned in plural lines extending in the Z-axis direction of the heat exchanger tube (i.e. the direction of fluid flow).

Each protrusion 120, formed into the same configuration as protrusion 70 of the seventh embodiment shown in FIGS. 7A to 7C, comprises a top surface 121, two side surfaces 122, a gradual slant surface 124*a*, and a steep slant surface 124*b*.

Top surface 121, extending in parallel with X-Z plane, has a constant lateral (X-direction) width. A ridge line 121*a*, along which side surface 122 intersects with top surface 121, is straight and extends in parallel with a longitudinal center line 125 of protrusion 120.

Each side surface 122, defined between ridge line 121*a* and base line 128, is a gradual slant surface slightly inclined with respect to the direction of fluid flow (i.e. Z-direction).

Between adjacent two parallel rows consisting of consecutive protrusions 120—120, there is formed an undulated bottom 126 extending in the Z-axis direction of the heat exchanger tube (i.e. the direction of fluid flow). Undulated bottom 126 is identical in configuration and arrangement with the undulated bottom 27 of the second embodiment shown in FIGS. 2A and 2B.

Undulated bottom 126 comprises consecutive waves 127 each consisting of a gradual slant surface 123 and a steep slant surface 124*b*. The steep slant surface 124*b* forms a common steep slant surface laterally extending from protrusion 120 and adjacent wave 127. Side surface 122 intersects with gradual slant surface 123 along base line 128.

Gradual slant surface 124*a* and slant side surface 122 face against the fluid flow "C" in a condensation phase. On the other hand, steep slant surface 124*b* faces against the fluid flow "B" in a vaporization phase.

In short, the twelfth embodiment is substantially the combination of the first embodiment, the second embodiment and the fourth embodiment, bringing a composite effect of them.

When the fluid in the heat exchanger tube is vaporized, fluid flow "B" collides with steep slant surface 124*b*. Resistance to the fluid flow "B" is fairly large due to steepness of slant surface 124*b*. Hence, in the vaporization phase of the fluid in the heat exchanger tube, it becomes possible to effectively cause disturbance in the fluid flow "B", increasing the pressure loss (i.e. resistance to the fluid flow "B").

On the other hand, when fluid in the heat exchanger tube is condensed, fluid flow "C" collides with gradual slant surfaces 124*a* and 122. Gradualness of slant surfaces 124*a* and 122 brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the resistance to the fluid flow "C".

Formation of side surfaces 122 of protrusions 120 enlarges the wetted area or length, realizing a high efficiency in heat exchange.

As apparent from the foregoing description, the twelfth embodiment of the present invention provides a heat exchanger tube having an inside wall groove configuration whose cross-sectional area normal to the center line thereof varies in such a manner that the increased rate of the cross-sectional area is differentiated from the decreased rate of the cross-sectional area (i.e. the increased rate is always larger than the decreased rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

More specifically, according to the twelfth embodiment, the cross-sectional area of the groove configuration varies in accordance with a change of the height of a protruding portion and also varies in accordance with a change of the depth and the width of a recessed portion, the protruding portion and the recessed portion respectively constituting part of the groove configuration.

Thirteenth Embodiment

Figure 13A:
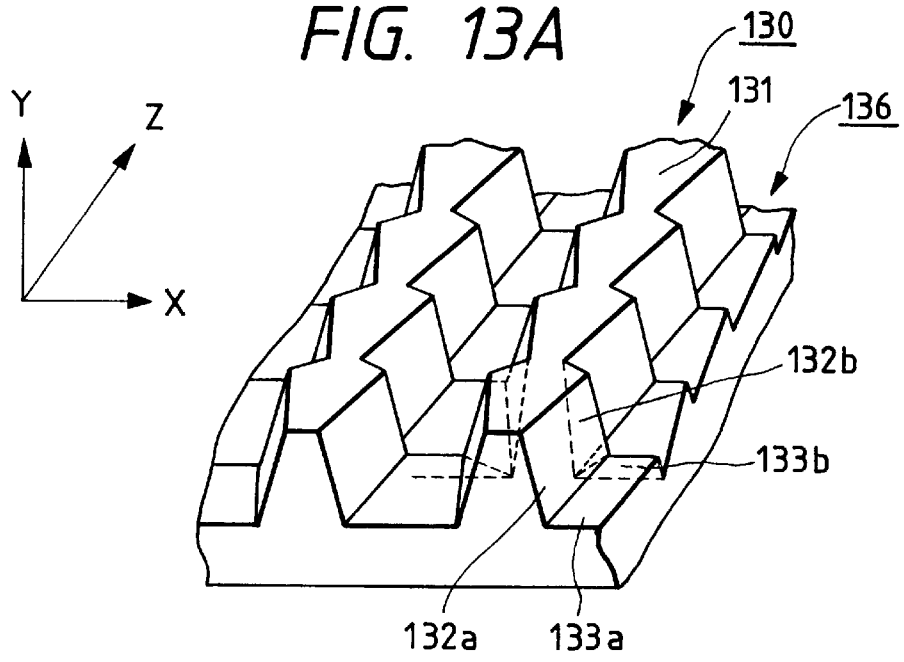
FIG. 13A is a perspective view showing a groove configuration formed on an inside wall of a heat exchanger tube in accordance with a thirteenth embodiment of the present invention.
Figure 13B:
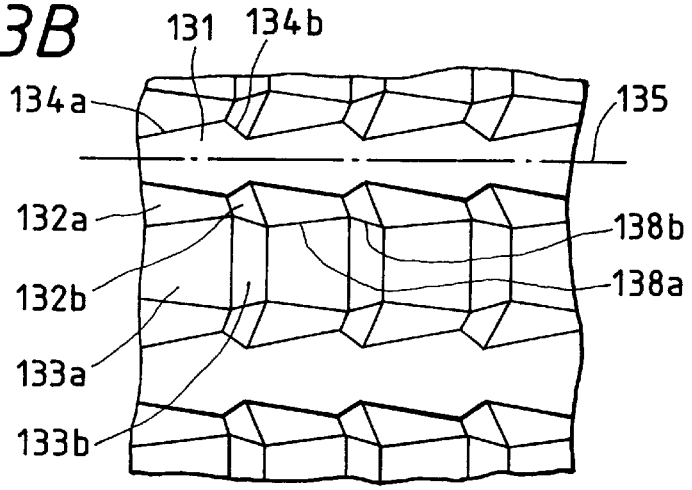
FIG. 13B is a plan view showing the groove configuration of FIG. 13A.
Figure 13C:
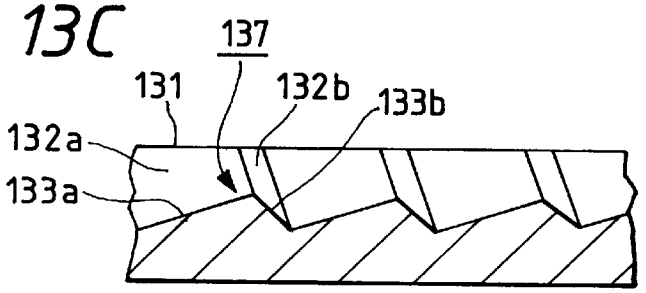
FIG. 13C is a side view showing the groove configuration of FIG. 13A.

A thirteenth embodiment of the present invention will be explained with reference to FIGS. 13A through 13C. FIG. 13A is a perspective view showing a groove configuration formed on an inside wall of a heat exchanger tube in accordance with the thirteenth embodiment of the present invention. FIG. 13B is a plan view showing the groove configuration of FIG. 13A. FIG. 13C is a side view showing the groove configuration of FIG. 13A.

A plurality of undulated ridges 130, provided on the inside wall of the heat exchanger tube, are aligned in parallel with each other so as to extend in the Z-axis direction of the heat exchanger tube (i.e. the direction of fluid flow). Undulated ridge 130, identical in configuration and arrangement with undulated ridge 100 of the tenth embodiment shown in FIGS. 10A to 10C, comprises a top surface 131 and symmetrical side surfaces 132*a*, 132*b*. Top surface 131 is parallel to X-Z plane and extends in the Z-axis direction of the heat exchange tube (i.e. the direction of fluid flow).

Side surfaces 132*a* and 132*b*, which are sequentially and alternately aligned slant surfaces, intersect with top surface 131 along an upper zigzag line (ridge lines 134*a* and 134*b*). Side surfaces 132*a* and 132*b* intersect with an undulated bottom 136 along a lower zigzag line (base lines 138*a* and 138*b*).

More specifically, lateral width (X-direction width) of top surface 131 is gradually changed with respect to a center line 135 of ridge 130 (extending in the Z-axis direction of the heat exchanger tube) in a region where top surface 131 and side surface 132*a* intersect along ridge line 134*a* (i.e. part of the upper zigzag line). The lateral width of top surface 131 is steeply changed in another region where top surface 131 and side surface 132*b* intersect along ridge line 134*b*.

Side surface 132*a*, defined between ridge line 134*a* and base line 138*a*, is a gradual slant surface slightly inclined with respect to the direction of fluid flow (i.e. Z-direction). Side surface 132*b*, defined between ridge line 134*b* and base line 138*b*, is a steep slant surface fairly inclined with respect to the direction of fluid flow (i.e. Z-direction).

Between adjacent two parallel ridges 130 and 130, there is formed undulated bottom 136 extending in the Z-axis direction of the heat exchanger tube (i.e. the direction of fluid flow). Undulated bottom 136 is identical in configuration and arrangement with the undulated bottom 27 of the second embodiment shown in FIGS. 2A and 2B.

Undulated bottom 136 comprises consecutive waves 137 each consisting of a gradual slant surface 133*a* and a steep slant surface 133*b*.

Gradual slant side surface 132*a* and gradual slant surface 133*a* face against the fluid flow "C" in a condensation phase. On the other hand, steep slant side surface 132*b* and gradual slant surface 133*b* face against the fluid flow "B" in a vaporization phase.

In short, the thirteenth embodiment is substantially the combination of the second embodiment, the third embodiment and the fourth embodiment, bringing a composite effect of them.

When the fluid in the heat exchanger tube is vaporized, fluid flow "B" collides with steep slant surfaces 132*b* and 133*b*. Resistance to the fluid flow "B" is fairly large due to steepness of slant surfaces 132*b* and 133*b*. Hence, in the vaporization phase of the fluid in the heat exchanger tube, it becomes possible to effectively cause disturbance in the fluid flow "B", increasing the pressure loss (i.e. resistance to the fluid flow "B").

On the other hand, when fluid in the heat exchanger tube is condensed, fluid flow "C" collides with gradual slant surfaces 132*a* and 133*a*. Gradualness of slant surfaces 132*a* and 133*a* brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the resistance to the fluid flow "C".

Formation of side surfaces 132*a* and 132*b* of ridges 130 enlarges the wetted area or length, realizing a high efficiency in heat exchange.

As apparent from the foregoing description, the thirteenth embodiment of the present invention provides a heat exchanger tube having an inside wall groove configuration whose cross-sectional area normal to the center line thereof varies in such a manner that the increased rate of the cross-sectional area is differentiated from the decreased rate of the cross-sectional area (i.e. the increased rate is always larger than the decreased rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

More specifically, according to the thirteenth embodiment, the cross-sectional area of the groove configuration varies in accordance with a change of the top width of a protruding portion and also varies in accordance with a change of the depth and the width of a recessed portion, the protruding portion and the recessed portion respectively constituting part of the groove configuration.

Fourteenth Embodiment

Figure 14A:
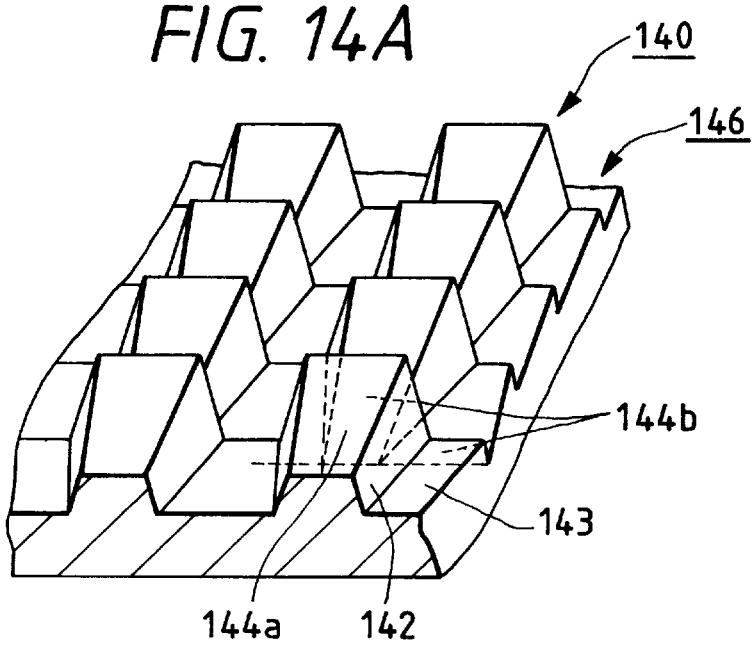
FIG. 14A is a perspective view showing a groove configuration formed on an inside wall of a heat exchanger tube in accordance with a fourteenth embodiment of the present invention.
Figure 14B:
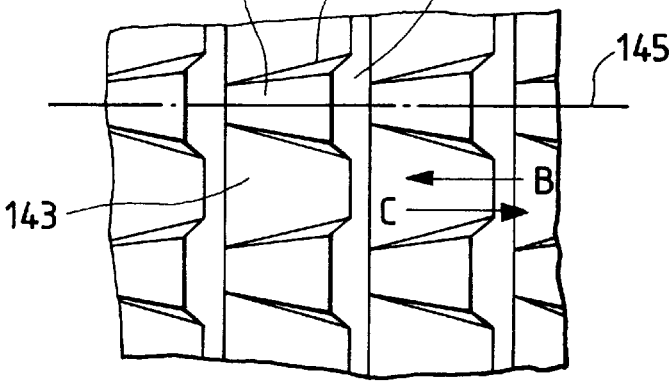
FIG. 14B is a plan view showing the groove configuration of FIG. 14A.
Figure 14C:
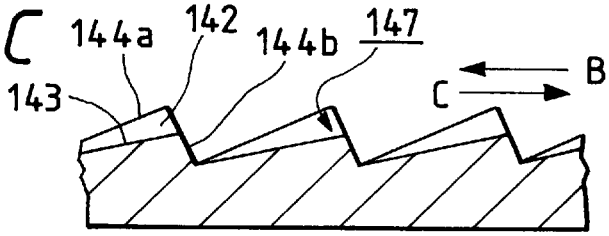
FIG. 14C is a side view showing the groove configuration of FIG. 14A.

A fourteenth embodiment of the present invention will be explained with reference to FIGS. 14A through 14C. FIG. 14A is a perspective view showing a groove configuration formed on an inside wall of a heat exchanger tube in accordance with the fourteenth embodiment of the present invention. FIG. 14B is a plan view showing the groove configuration of FIG. 14A. FIG. 14C is a side view showing the groove configuration of FIG. 14A.

A plurality of undulated ridges 140, provided on the inside wall of the heat exchanger tube, are aligned in parallel with each other so as to extend in the Z-axis direction of the heat exchanger tube (i.e. the direction of fluid flow). Undulated ridge 140 comprises a gradual slant surface 144*a*, a steep slant surface 144*b*, and symmetrical side surfaces 142.

More specifically, lateral width (X-direction width) of gradual slant surface 144*a* is gradually changed with respect to a center line 145 of ridge 140 (extending in the Z-axis direction of the heat exchanger tube). Side surface 142 is a gradual slant surface slightly inclined with respect to the direction of fluid flow (i.e. Z-direction).

Between adjacent two parallel ridges 140 and 140, there is formed undulated bottom 146 extending in the Z-axis direction of the heat exchanger tube (i.e. the direction of fluid flow). Undulated bottom 146 comprises consecutive waves 147 each consisting of a gradual slant surface 143 and steep slant surface 144*b*. Steep slant surface 144*b* forms a common steep slant surface laterally extending from protrusion 140 and adjacent wave 147.

Gradual slant surface 144*a*, 142 and 143 face against the fluid flow "C" in a condensation phase. On the other hand, steep slant surface 144*b* faces against the fluid flow "B" in a vaporization phase.

In short, the thirteenth embodiment is substantially the combination of the first embodiment, the second embodiment, the third embodiment and the fourth embodiment, bringing a composite effect of them.

When the fluid in the heat exchanger tube is vaporized, fluid flow "B" collides with steep slant surface 144*b*. Resistance to the fluid flow "B" is fairly large due to steepness of slant surface 144*b*. Hence, in the vaporization phase of the fluid in the heat exchanger tube, it becomes possible to effectively cause disturbance in the fluid flow "B", increasing the pressure loss (i.e. resistance to the fluid flow "B").

On the other hand, when fluid in the heat exchanger tube is condensed, fluid flow "C" collides with gradual slant surfaces 144*a*, 142 and 143. Gradualness of slant surfaces 144*a*, 142 and 143 brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the resistance to the fluid flow "C".

Formation of side surfaces 142 of ridges 140 enlarges the wetted area or length, realizing a high efficiency in heat exchange.

As apparent from the foregoing description, the fourteenth embodiment of the present invention provides a heat exchanger tube having an inside wall groove configuration whose cross-sectional area normal to the center line thereof varies in such a manner that the increased rate of the cross-sectional area is differentiated from the decreased rate of the cross-sectional area (i.e. the increased rate is always larger than the decreased rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

More specifically, according to the fourteenth embodiment, the cross-sectional area of the groove configuration varies in accordance with a change of the height and the top width of a protruding portion and also varies in accordance with a change of the depth and the width of a recessed portion, the protruding portion and the recessed portion respectively constituting part of the groove configuration.

Fifteenth Embodiment

Figure 16:
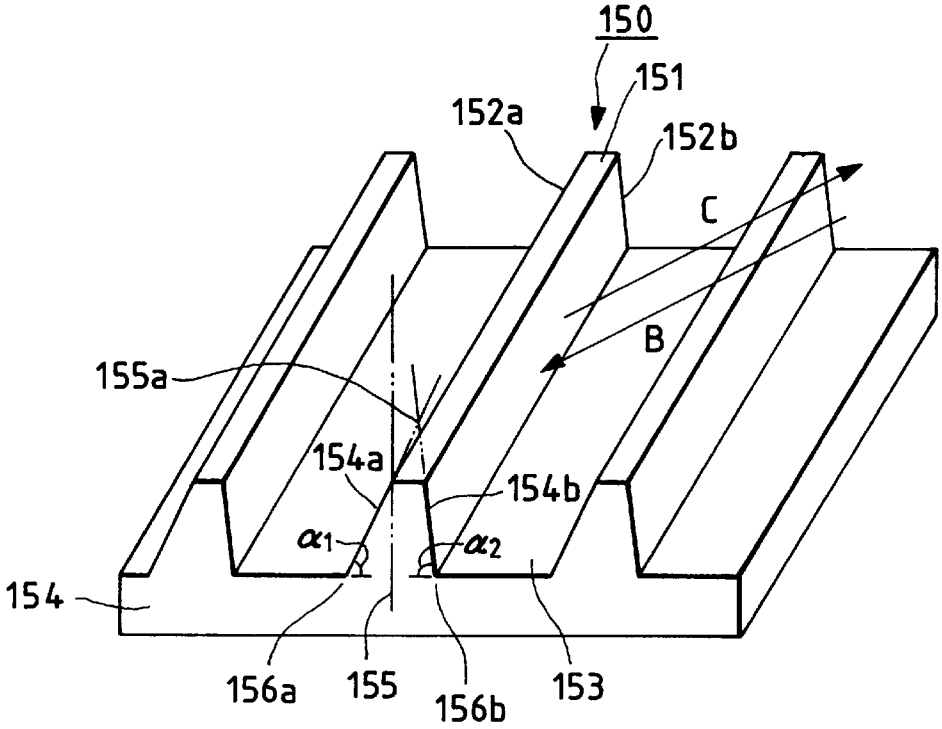
FIG. 16 is a perspective view showing a groove configuration formed on an inside wall of a heat exchanger tube in accordance with the fifteenth embodiment of the present invention.
Figure 17:
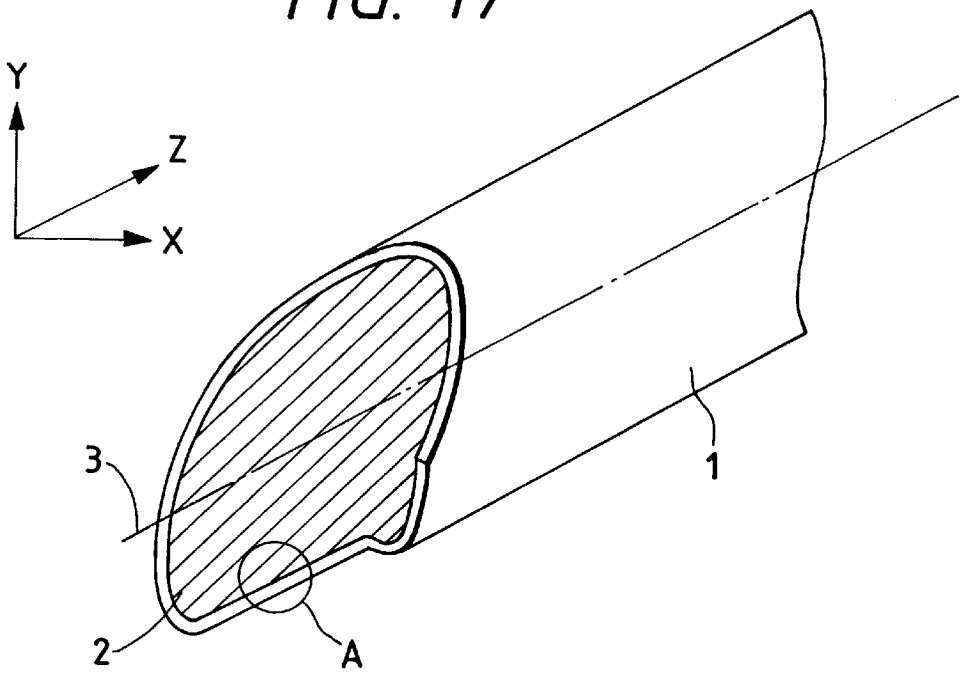
FIG. 17 is a perspective view showing a heat exchanger tube.
Figure 18:
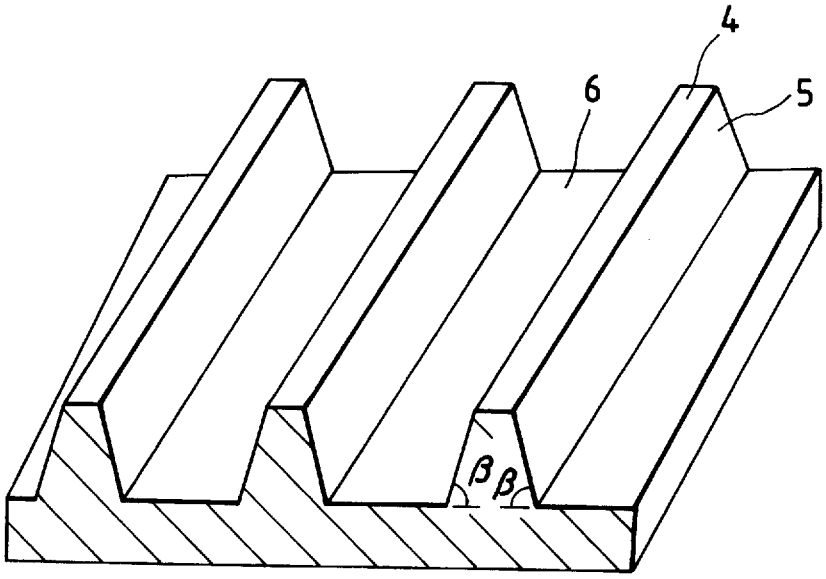
FIG. 18 PRIOR ART
FIG. 18 is a perspective view enlargedly showing a conventional groove configuration at a portion corresponding to "A" of FIG. 17.
Figure 19:
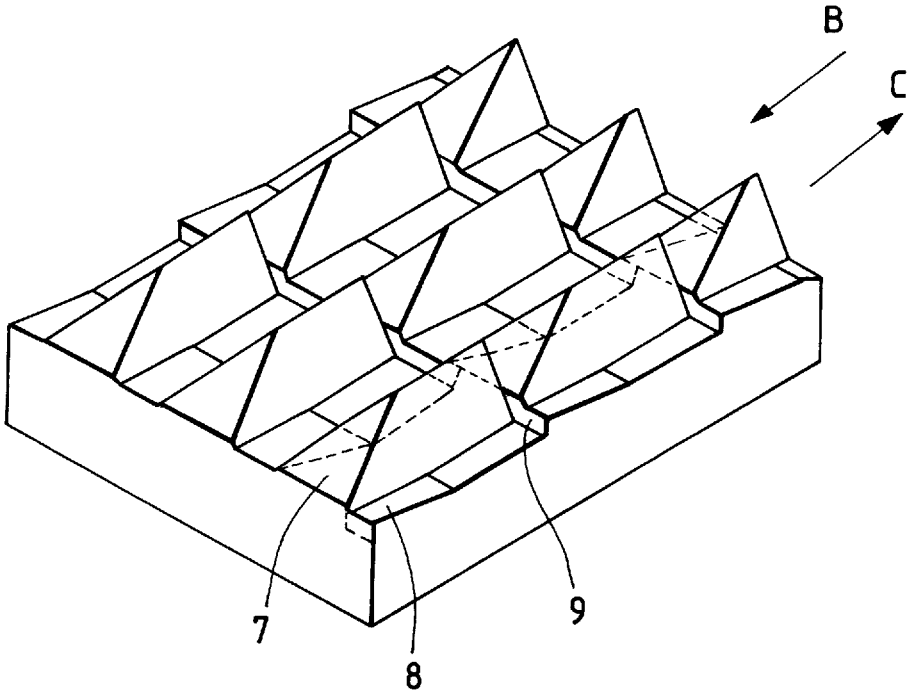
FIG. 19 PRIOR ART
FIG. 19 is a perspective view enlargedly showing another conventional groove configuration at a portion corresponding to "A" of FIG. 17.

A fifteenth embodiment of the present invention will be explained with reference to FIGS. 16. FIG. 16 is a perspective view showing a groove configuration formed on an inside wall of a heat exchanger tube in accordance with the fifteenth embodiment of the present invention.

A plurality of ridges 150, provided on the inside wall of the heat exchanger tube, are aligned in parallel with each other so as to extend inclinedly with respect to the direction of fluid flow. Each ridge 150 comprises a top surface 151, a gradual slant side surface 152*a*, and a steep slant surface 152*b*.

Between adjacent two ridges 150 and 150, there is provided a flat bottom 153.

More specifically, gradual slant side surface 152*a* is inclined with respect to bottom 153 at a base angle al which is an angle between a line 154*a* and bottom 153. Line 154*a* in an intersecting line between gradual slant side surface 152*a* and a cross-sectional plane 154 normal to a longitudinal center line of ridge 150.

Steep slant side surface 152*b* is inclined with respect to bottom 153 at a base angle $\alpha 2$ which is an angle between a line 154*b* and bottom 153. Line 154*b* in an intersecting line between steep slant side surface 152*b* and cross-sectional plane 154.

A crossing point 155*a* of lines 154*a* and 154*b* is offset from a vertical bisector 155 of a lateral base segment (156*a*–156*b*) of ridge 150, because base angle al is smaller than base angle $\alpha 2$.

Gradual slant side surface 152*a* faces against the fluid flow "C" in a condensation phase. On the other hand, steep slant side surface 152*b* faces against the fluid flow "B" in a vaporization phase.

When the fluid in the heat exchanger tube is vaporized, fluid flow "B" collides with steep slant side surface 152*b*. Resistance to the fluid flow "B" is fairly large due to steepness of slant side surface 152*b*. Hence, in the vaporization phase of the fluid in the heat exchanger tube, it becomes possible to effectively cause disturbance in the fluid flow "B", increasing the pressure loss (i.e. resistance to the fluid flow "B")

On the other hand, when fluid in the heat exchanger tube is condensed, fluid flow "C" collides with gradual slant side surface 152*a*. Gradualness of slant surface 152*a* brings a small resistance to the fluid flow "C", compared with the resistance to the fluid flow "B". Thus, in the condensation phase of the fluid in the heat exchanger tube, it becomes possible to reduce the disturbance in the fluid flow "C" while effectively suppressing the resistance to the fluid flow "C".

As apparent from the foregoing description, the fifteenth embodiment of the present invention provides a heat exchanger tube having an inside wall configuration whose cross-sectional area normal to the center line thereof varies in such a manner that the increased rate of the cross-sectional area is differentiated from the decreased rate of the cross-sectional area (i.e. the increased rate is always larger than the decreased rate in one direction, and is always smaller in the opposite direction), thereby increasing the pressure loss (i.e. resistance to the fluid flow "B") in the vaporization phase while suppressing the pressure loss (i.e. resistance to the fluid flow "C") in the condensation phase.

As this invention may be embodied in several forms without departing from the spirit of essential characteristics thereof, the present embodiments described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A heat exchanger tube comprising:

a groove configuration formed on an inside wall of said heat exchanger tube so as to have a cross-sectional area normal to a center line of said heat exchanger tube;

said groove configuration having a first region and a second region where said cross-sectional area of said groove configuration varies, wherein said cross-sectional area of said groove configuration increases in the first region while said cross-sectional area decreases in the second region, and a rate of increase of said cross-sectional area in said first region is differentiated from a rate of decrease of said cross-sectional area in said second region, said cross-sectional area of said groove configuration varies in accordance with a change of the depth of a recessed portion with respect to said center line constituting part of said groove configuration, while a protruding portion with respect to said center line constituting part of said groove configuration causes no counteractive change canceling the variation in said recessed portion of said groove configuration.

2. A heat exchanger tube comprising:

a groove configuration formed on an inside wall of said heat exchanger tube so as to have a cross-sectional area normal to a center line of said heat exchanger tube;

said groove configuration having a first region and a second region where said cross-sectional area of said groove configuration varies, wherein said cross-sectional area of said groove configuration increases in the first region while said cross-sectional area decreases in the second region, and a rate of increase of said cross-sectional area in said first region is differentiated from a rate of decrease of said cross-sectional area in said second region, said cross-sectional area of said groove configuration varies in accordance with a change of the top width of a protruding portion with respect to said center line constituting part of said groove configuration, while a recessed portion with respect to said center line constituting part of said groove configuration causes no counteractive change canceling the variation in said protruding portion of said groove configuration.

3. A heat exchanger tube comprising:

a groove configuration formed on an inside wall of said heat exchanger tube so as to have a cross-sectional area normal to a center line of said heat exchanger tube;

said groove configuration having a first region and a second region where said cross-sectional area of said groove configuration varies, wherein said cross-sectional area of said groove configuration increases in the first region while said cross-sectional area decreases in the second region, and a rate of increase of said cross-sectional area in said first region is differentiated from a rate of decrease of said cross-sectional area in said second region, said cross-sectional area of said groove configuration varies in accordance with a change of the height of a protruding portion and also varies in accordance with a change of depth of a recessed portion, said protruding portion and said recessed portion respectively constituting part of said groove configuration, and the variation in said protruding portion is not counteractive against the variation in said recessed portion.

4. A heat exchanger tube comprising:

a groove configuration formed on an inside wall of said heat exchanger tube so as to have a cross-sectional area normal to a center line of said heat exchanger tube;

said groove configuration having a first region and a second region where said cross-sectional area of said groove configuration varies, wherein said cross-sectional area of said groove configuration increases in the first region while said cross-sectional area decreases in the second region, and a rate of increase of said cross-sectional area in said first region is differentiated from a rate of decrease of said cross-sectional area in said second region, said cross-sectional area of said groove configuration varies in accordance with a change of the height of a protruding portion with respect to said center line and also varies in accordance with a change of the top width of said protruding portion, said protruding portion constituting part of said groove configuration, and a recessed portion with respect to said center line constituting part of said groove configuration causes no counteractive change canceling the variation in said protruding portion.

5. A heat exchanger tube comprising:

a groove configuration formed on an inside wall of said heat exchanger tube so as to have a cross-sectional area normal to a center line of said heat exchanger tube;

said groove configuration having a first region and a second region where said cross-sectional area of said groove configuration varies, wherein said cross-sectional area of said groove configuration increases in the first region while said cross-sectional area decreases in the second region, and a rate of increase of said cross-sectional area in said first region is differentiated from a rate of decrease of said cross-sectional area in said second region, said cross-sectional area of said groove configuration varies in accordance with a change of the depth of a recessed portion and also varies in accordance with a change of the top width of a protruding portion, said recessed portion and said protruding portion respectively constituting part of said groove configuration, and the variation in said protruding portion is not counteractive against the variation in said recessed portion.

6. A heat exchanger tube comprising:

a groove configuration formed on an inside wall of said heat exchanger tube so as to have a cross-sectional area normal to a center line of said heat exchanger tube;

said groove configuration having a first region and a second region where said cross-sectional area of said groove configuration varies, wherein said cross-sectional area of said groove configuration increases in the first region while said cross-sectional area decreases in the second region, and a rate of increase of said cross-sectional area in said first region is differentiated from a rate of decrease of said cross-sectional area in said second region, said cross-sectional area of said groove configuration varies in accordance with a change of both the height and the top width of a protruding portion and also varies in accordance with a change of the depth of a recessed portion, said protruding portion and said recessed portion respectively constituting part of said groove configuration, and the variation in said protruding portion is not counteractive against the variation in said recessed portion.

7. A heat exchanger tube comprising:

a groove configuration formed on an inside wall of said heat exchanger tube so as to have a cross-sectional area normal to a center line of said heat exchanger tube;

said groove configuration having a first region and a second region where said cross-sectional area of said groove configuration varies in accordance with a change of the bottom width of a recessed portion constituting part of said groove configuration formed on the inside wall of said heat exchanger tube, and said cross-sectional area of said groove configuration increases in the first region while said cross-sectional area decreases in the second region, and a rate of increase of said cross-sectional area in said first region is differentiated from a rate of decrease of said cross-sectional area in said second region.

8. A heat exchanger tube comprising:

a groove configuration formed on an inside wall of said heat exchanger tube so as to have a cross-sectional area normal to a center line of said heat exchanger tube;

said groove configuration having a first region and a second region where said cross-sectional area of said groove configuration varies in accordance with a change of the height of a protruding portion and also varies in accordance with a change of the bottom width of a recessed portion, said protruding portion and said recessed portion respectively constituting part of said groove configuration, and said cross-sectional area of said groove configuration increases in the first region while said cross-sectional area decreases in the second region, and a rate of increase of said cross-sectional area in said first region is differentiated from a rate of decrease of said cross-sectional area in said second region.

9. A heat exchanger tube comprising:

a groove configuration formed on an inside wall of said heat exchanger tube so as to have a cross-sectional area normal to a center line of said heat exchanger tube;

said groove configuration having a first region and a second region where said cross-sectional area of said groove configuration varies in accordance with a change of the depth of a recessed portion and also varies in accordance with a change of the bottom width of said recessed portion, said recessed portion constituting part of said groove configuration, and said cross-sectional area of said groove configuration increases in the first region while said cross-sectional area decreases in the second region, and a rate of increase of said cross-sectional area in said first region is differentiated from a rate of decrease of said cross-sectional area in said second region.

10. A heat exchanger tube comprising:

a groove configuration formed on an inside wall of said heat exchanger tube so as to have a cross-sectional area normal to a center line of said heat exchanger tube;

said groove configuration having a first region and a second region where said cross-sectional area of said groove configuration varies in accordance with a change of the height of a protruding portion and also varies in accordance with a change of both the depth and bottom width of a recessed portion, said protruding portion and said recessed portion respectively constituting part of said groove configuration, and said cross-sectional area of said groove configuration increases in the first region while said cross-sectional area decreases in the second region, and a rate of increase of said cross-sectional area in said first region is differentiated from a rate of decrease of said cross-sectional area in said second region.

11. A heat exchanger tube comprising:

a groove configuration formed on an inside wall of said heat exchanger tube so as to have a cross-sectional area normal to a center line of said heat exchanger tube;

said groove configuration having a first region and a second region where said cross-sectional area of said groove configuration varies in accordance with a change of the top width of a protruding portion and also varies in accordance with a change of both the depth and bottom width of a recessed portion, said protruding portion and said recessed portion respectively constituting part of said groove configuration, and said cross-sectional area of said groove configuration increases in the first region while said cross-sectional area decreases in the second region, and a rate of increase of said cross-sectional area in said first region is differentiated from a rate of decrease of said cross-sectional area in said second region.

12. A heat exchanger tube comprising:

a groove configuration formed on an inside wall of said heat exchanger tube so as to have a cross-sectional area normal to a center line of said heat exchanger tube;

said groove configuration having a first region and a second region where said cross-sectional area of said groove configuration varies in accordance with a change of the height and the top width of a protruding portion and also varies in accordance with a change of both the depth and the bottom width of a recessed portion, said protruding portion and said recessed portion respectively constituting part of said groove configuration, and said cross-sectional area of said groove configuration increases in the first region while said cross-sectional area decreases in the second region, and a rate of increase of said cross-sectional area in said first region is differentiated from a rate of decrease of said cross-sectional area in said second region.

13. A heat exchanger tube comprising:

a groove configuration formed on an inside wall of said heat exchanger tube having a cross sectional area normal to a center line of said heat exchanger tube, said groove configuration comprising a plurality of protruding portions and recessed portions, wherein a cross-sectional area of said protruding portions and a cross-sectional area of said recessed portions cooperatively increase and decrease in a direction of the center line of said heat exchanger tube to avoid counteractive variations between said cross-sectional areas; and an absolute value of an increased rate of said cross-sectional area is differentiated from an absolute value of a decreased rate of said cross-sectional area in each of said protruding portions and said recessed portions.

14. The heat exchanger tube in accordance with claim 13, wherein said cross-sectional area of said recessed portion varies in accordance with a change of the depth of said recessed portion.

15. The heat exchanger tube in accordance with claim 13, wherein said cross-sectional area of said protruding portion varies in accordance with a change of the width of said protruding portion.

16. The heat exchanger tube in accordance with claim 13, wherein said cross-sectional area of said recessed portion varies in accordance with a change of the width of said recessed portion.

17. The heat exchanger tube in accordance with claim 13, wherein said cross-sectional area of said protruding portion varies in accordance with a change of the height of said protruding portion while said cross-sectional area of said recessed portion varies in accordance with a change of the depth of said recessed portion, and an increase of the height of said protruding portion is cooperative with a decrease of the depth of said recessed portion.

18. The heat exchanger tube in accordance with claim 13, wherein said cross-sectional area of said protruding portion varies in accordance with both changes of the height and the width of said protruding portion, and an increase of the height of said protruding portion is cooperative with an increase of the width of said protruding portion.

19. The heat exchanger tube in accordance with claim 13, wherein said cross-sectional area of said protruding portion varies in accordance with a change of the width of said protruding portion while said cross-sectional area of said recessed portion varies in accordance with a change of the depth of said recessed portion, and an increase of the width of said protruding portion is cooperative with a decrease of the depth of said recessed portion.

20. The heat exchanger tube in accordance with claim 13, wherein said cross-sectional area of said recessed portion varies in accordance with both changes of the depth and the width of said recessed portion, and a decrease of the depth of said recessed portion is cooperative with a decrease of the width of said recessed portion.

21. The heat exchanger tube in accordance with claim 13, wherein said cross-sectional area of said protruding portion varies in accordance with a change of the width of said protruding portion while said cross-sectional area of said recessed portion varies in accordance with a change of the width of said recessed portion, and an increase of the width of said protruding portion is cooperative with a decrease of the width of said recessed portion.

22. The heat exchanger tube in accordance with claim 13, wherein said cross-sectional area of said protruding portion varies in accordance with both changes of the height and the width of said protruding portion while said cross-sectional area of said recessed portion varies in accordance with a change of the depth of said recessed portion, and increases of the height and the width of said protruding portion are cooperative with a decrease of the depth of said recessed portion.

23. The heat exchanger tube in accordance with claim 13, wherein said cross-sectional area of said protruding portion varies in accordance with a change of the height of said protruding portion while said cross-sectional area of said recessed portion varies in accordance with both changes of the depth and the width of said recessed portion, and an increase of the height of said protruding portion is cooperative with decreases of the depth of said recessed portion.

24. The heat exchanger tube in accordance with claim 13, wherein said cross-sectional area of said protruding portion varies in accordance with a change of the width of said protruding portion while said cross-sectional area of said recessed portion varies in accordance with both changes of the depth and the width of said recessed portion, and an increase of the width of said protruding portion is cooperative with decreases of the depth and the width of said recessed portion.

25. The heat exchanger tube in accordance with claim 13, wherein said cross-sectional area of said protruding portion varies in accordance with both changes of the height and the width of said protruding portion while said cross-sectional area of said recessed portion varies in accordance with both changes of the depth and the width of said recessed portion, and increases of the height and the width of said protruding portion are cooperative with decreases of the depth and the width of said recessed portion.

* * * * *